US007984902B2

(12) United States Patent
Kuroda

(10) Patent No.: US 7,984,902 B2
(45) Date of Patent: Jul. 26, 2011

(54) SHEET FEEDING DEVICE AND IMAGE FORMING APPARATUS

(75) Inventor: Naomi Kuroda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 350 days.

(21) Appl. No.: 12/167,337

(22) Filed: Jul. 3, 2008

(65) Prior Publication Data

US 2009/0008868 A1 Jan. 8, 2009

(30) Foreign Application Priority Data

Jul. 4, 2007 (JP) ..... 2007-176317

(51) Int. Cl.
*B65H 1/14* (2006.01)

(52) U.S. Cl. ..... 271/156; 271/153; 271/152

(58) Field of Classification Search ..... 271/152, 271/153, 154, 155, 156
See application file for complete search history.

(56) References Cited

U.S. PATENT DOCUMENTS

| | | | | |
|---|---|---|---|---|
| 3,580,567 | A * | 5/1971 | Hasimoto | 271/154 |
| 3,724,839 | A * | 4/1973 | Suzuki | 271/117 |
| 5,501,444 | A | 3/1996 | Yukimachi et al. | |
| 5,895,038 | A * | 4/1999 | Takashima | 271/114 |
| 6,422,773 | B1 * | 7/2002 | Lim | 400/710 |
| 6,783,126 | B2 * | 8/2004 | Amamoto | 271/152 |
| 6,994,341 | B2 * | 2/2006 | Aoki et al. | 271/117 |
| 7,357,388 | B2 * | 4/2008 | Dan | 271/127 |
| 7,457,580 | B2 * | 11/2008 | Kitamura | 399/393 |
| 7,513,496 | B2 | 4/2009 | Hattori | |
| 2005/0051944 | A1 | 3/2005 | Makino et al. | |
| 2006/0113722 | A1 | 6/2006 | Hattori | |

FOREIGN PATENT DOCUMENTS

| | | | |
|---|---|---|---|
| JP | 54-031301 | A | 3/1979 |
| JP | 60-097134 | A | 5/1985 |
| JP | 1-214528 | A | 8/1989 |
| JP | 6-227683 | A | 8/1994 |
| JP | 07-053065 | | 2/1995 |
| JP | 7-144771 | A | 6/1995 |
| JP | 8-208059 | A | 8/1996 |
| JP | 11-322090 | A | 11/1999 |
| JP | 2005-041645 | | 2/2005 |
| JP | 2006-151655 | | 6/2006 |

OTHER PUBLICATIONS

JP Office Action dtd Jun. 4, 2009, JP Appln. 2007-176317.

* cited by examiner

*Primary Examiner* — Stefanos Karmis
*Assistant Examiner* — Ernesto Suarez
(74) *Attorney, Agent, or Firm* — Banner & Witcoff, Ltd.

(57) ABSTRACT

A sheet feeding device includes a loading portion configured to be loaded with a sheet, a lifting mechanism that lifts the loading portion in an operating state and stops the loading portion in an stopped state, a cam configured to be rotated alternately to a first rotational position for setting the lifting mechanism to the operating state and to a second rotational position for setting the lifting mechanism to the stopped state, a detecting unit having a contact portion movable up and down while contacting the sheet on the loading portion, which detects whether the sheet reaches a first height based upon the movement of the contact portion thereof, and a control unit configured to rotate the cam before the detecting unit detects that the sheet reaches the first height and to stop the cam in the second rotational position in response to the detection by the detecting unit.

14 Claims, 25 Drawing Sheets

[ WHEN PAPER FEEDING ROLLER IS IN THE LOWEST POSITION ]

[ WHEN PAPER FEEDING ROLLER IS IN THE LOWEST POSITION ]

[ WHEN PAPER FEEDING ROLLER IS IN THE LOWEST POSITION ]

[ WHEN PAPER FEEDING ROLLER IS IN SECOND RELEASE POSITION ]

[ WHEN PAPER FEEDING ROLLER IS IN SECOND RELEASE POSITION ]

[ WHEN PAPER FEEDING ROLLER IS IN SECOND RELEASE POSITION ]

[ WHEN CAM GEAR IS ENGAGED WITH DIFFERENTIAL GEAR ]

[ WHEN CAM GEAR IS ENGAGED WITH DIFFERENTIAL GEAR ]

[ WHEN CAM GEAR IS ENGAGED WITH DIFFERENTIAL GEAR ]

[ WHEN PAPER FEEDING ROLLER IS IN FIRST RELEASE POSITION ]

[ WHEN PAPER FEEDING ROLLER IS IN FIRST RELEASE POSITION ]

[ WHEN PAPER FEEDING ROLLER IS IN FIRST RELEASE POSITION ]

[ WHEN PAPER FEEDING ROLLER IS BETWEEN FIRST RELEASE POSITION AND SECOND RELEASE POSITION ]

[WHEN PAPER FEEDING ROLLER IS BETWEEN FIRST RELEASE POSITION AND SECOND RELEASE POSITION]

[ WHEN PAPER FEEDING ROLLER IS BETWEEN
FIRST RELEASE POSITION AND SECOND RELEASE POSITION ]

[ WHEN STORAGE CASSETTE IS INSERTED ]

[ WHEN SHEET COUNT IS REDUCED THROUGH PAPER FEEDING ]

SHEET FEEDING DEVICE AND IMAGE FORMING APPARATUS

CROSS-REFERENCE TO RELATED APPLICATION

This application claims priority under 35 U.S.C. §119 from Japanese Patent Application No. 2007-176317 filed on Jul. 4, 2007. The entire subject matter of the application is incorporated herein by reference.

BACKGROUND

1. Technical Field

The following description relates to one or more sheet feeding techniques for an image forming apparatus.

2. Related Art

Among image forming apparatuses, for example, there is an apparatus provided with a loading portion configured to be loaded with a sheet, a lifting mechanism configured to lift the loading portion, and a detecting unit configured to detect whether the loading portion reaches a predetermined height. It is noted that the predetermined height represents such a height that a sheet on the loading portion can be fed to a carrying route inside a main body of the apparatus.

In the meantime, a configuration has been known, in which ON/OFF control of a lifting operation by the lifting mechanism is mechanically performed with, for example, a cam (see Japanese Patent Provisional Publication No. 2006-151655). Specifically, the aforementioned configuration includes a cam and a control unit configured to control a rotational position of the cam. The control unit holds the cam in a first rotational position to set the lifting operation ON until the loading portion reaches the predetermined height, and rotates the cam to a second rotational position to set the lifting operation OFF when the loading portion reaches the predetermined height.

SUMMARY

In the aforementioned configuration, the lifting operation is maintained until the cam is rotated to the second rotational position from the first rotational position even after the loading portion reaches the predetermined height. A time-lag until the cam is rotated to the second rotational position from the first rotational position (hereinafter referred to as a first time-lag) cannot be avoided as far as the aforementioned configuration is applied, in which the ON/OFF control of the lifting operation by the lifting mechanism is mechanically performed with a cam mechanism.

However, in the aforementioned configuration, in addition to the first time-lag mechanically caused, there is caused a time-lag until the rotation of the cam to the second rotational position is actually started after it is detected that the loading portion reaches the predetermined height (hereinafter referred to as a second time-lag). Therefore, it is unfortunate that the lifting operation might be further continued even after the loading portion reaches the predetermined height and a sheet feeding performance might be worsened.

Aspects of the present invention is advantageous in that there are provided one or more improved sheet feeding devices and image forming apparatuses that make it possible to restrain worsening of sheet feeding performance even though a mechanical configuration is applied so as to control a lifting operation for a loading portion loaded with a sheet.

According to aspects of the present invention, there is provided a sheet feeding device, which includes a loading portion configured to be loaded with a stack of sheets and to be movable up and down, a lifting mechanism configured to lift the loading portion in an operating state and to stop the lifting of the loading portion in an stopped state, a cam configured to be rotated alternately to a first rotational position for setting the lifting mechanism to the operating state and to a second rotational position for setting the lifting mechanism to the stopped state, a detecting unit having a contact portion configured to be movable up and down while contacting a top sheet of the stack on the loading portion, the detecting unit being configured to detect whether the top sheet reaches a first height based upon the movement of the contact portion thereof, and a control unit configured to rotate the cam before the detecting unit detects that the top sheet reaches the first height and to stop the cam in the second rotational position in response to the detecting unit detecting that the top sheet reaches the first height.

In some aspects of the present invention, the cam is driven and rotated before the top sheet on the loading portion reaches the first height. Thereafter, until the top sheet reaches the first height, the lifting mechanism is repeatedly set alternately to the operating state and the stopped state, as the cam is rotated alternately to the first rotational position and the second rotational position. Thereby, the loading portion is intermittently lifted. After that, in response to the top sheet reaching the first height, an operation of stopping the cam being rotated is started, and the cam is then stopped. It is noted that, even in some aspects of the present invention, the first time-lag has to be caused that is taken for the cam to be rotated from the first rotational position to the second rotational position. However, in some aspects of the present invention, the cam has already been rotating before the sheet on the loading portion reaches the first height. Therefore, the lifting mechanism is stopped the first time-lag after the sheet reaches the first height. Thus, the second time-lag is not caused that is a time period until a start time to cause the cam rotate after it is detected that the sheet on the loading portion reaches the first height. Thereby, it is possible to prevent the worsening of sheet feeding performance better than the aforementioned conventional configuration.

According to another aspect of the present invention, there is provided an image forming apparatus, which a sheet feeding unit configured to feed a sheet, and an image forming unit configured to form an image on the sheet fed by the sheet feeding unit. The sheet feeding unit includes a loading portion configured to be loaded with a stack of sheets and to be movable up and down, a lifting mechanism configured to lift the loading portion in an operating state and to stop the lifting of the loading portion in an stopped state, a cam configured to be rotated alternately to a first rotational position for setting the lifting mechanism to the operating state and to a second rotational position for setting the lifting mechanism to the stopped state, a detecting unit having a contact portion configured to be movable up and down while contacting a top sheet of the stack on the loading portion, the detecting unit being configured to detect whether the top sheet reaches a first height based upon the movement of the contact portion thereof, and a control unit configured to rotate the cam before the detecting unit detects that the top sheet reaches the first height and to stop the cam in the second rotational position in response to the detecting unit detecting that the top sheet reaches the first height.

According to the image forming apparatus configured as above, the same effect as the aforementioned sheet feeding unit can be provided.

BRIEF DESCRIPTION OF THE ACCOMPANYING DRAWINGS

Illustrative aspects of the invention will be described in detail with reference to the following figures in which like elements are labeled with like numbers and in which.

Figure 13:
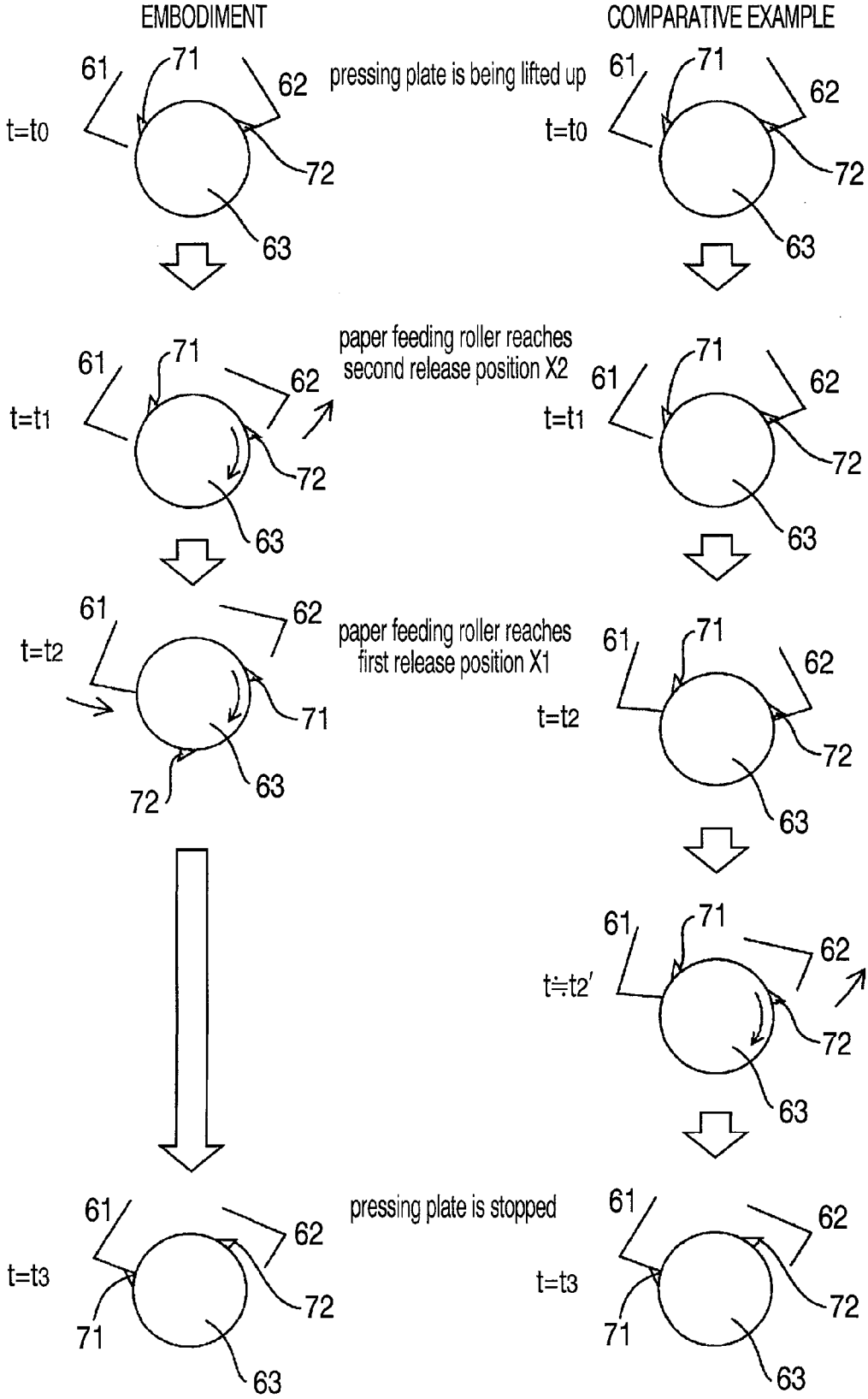

FIG. 13 schematically shows side views of the gear mechanism in a case where a storage cassette is inserted in the embodiment according to one or more aspects of the present invention and a comparative example.

Figure 14:
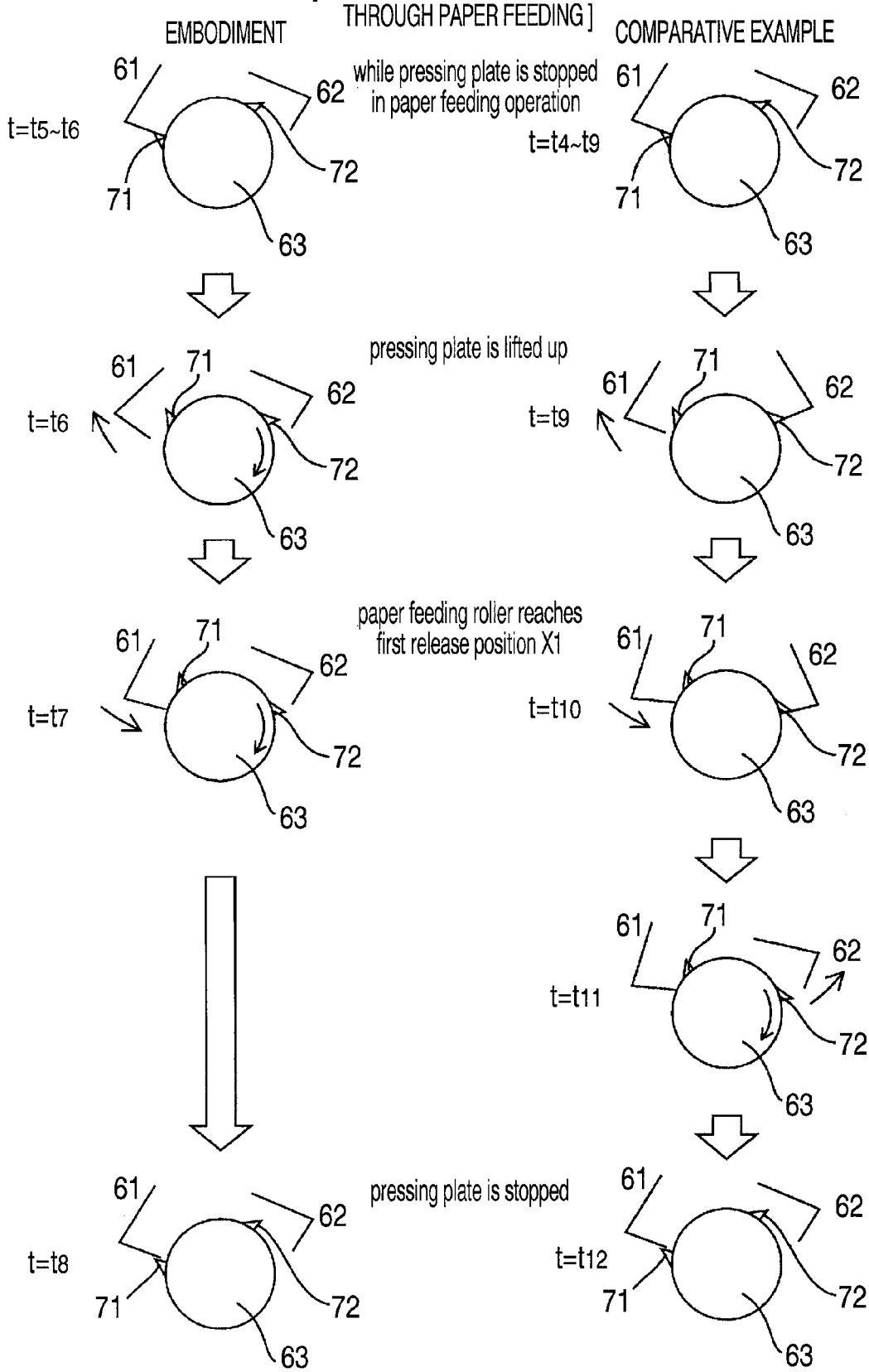

FIG. 14 schematically shows side views of the gear mechanism in a case where the number of sheets is reduced through a sheet feeding operation in the embodiment according to one or more aspects of the present invention and the comparative example.

Figure 15:
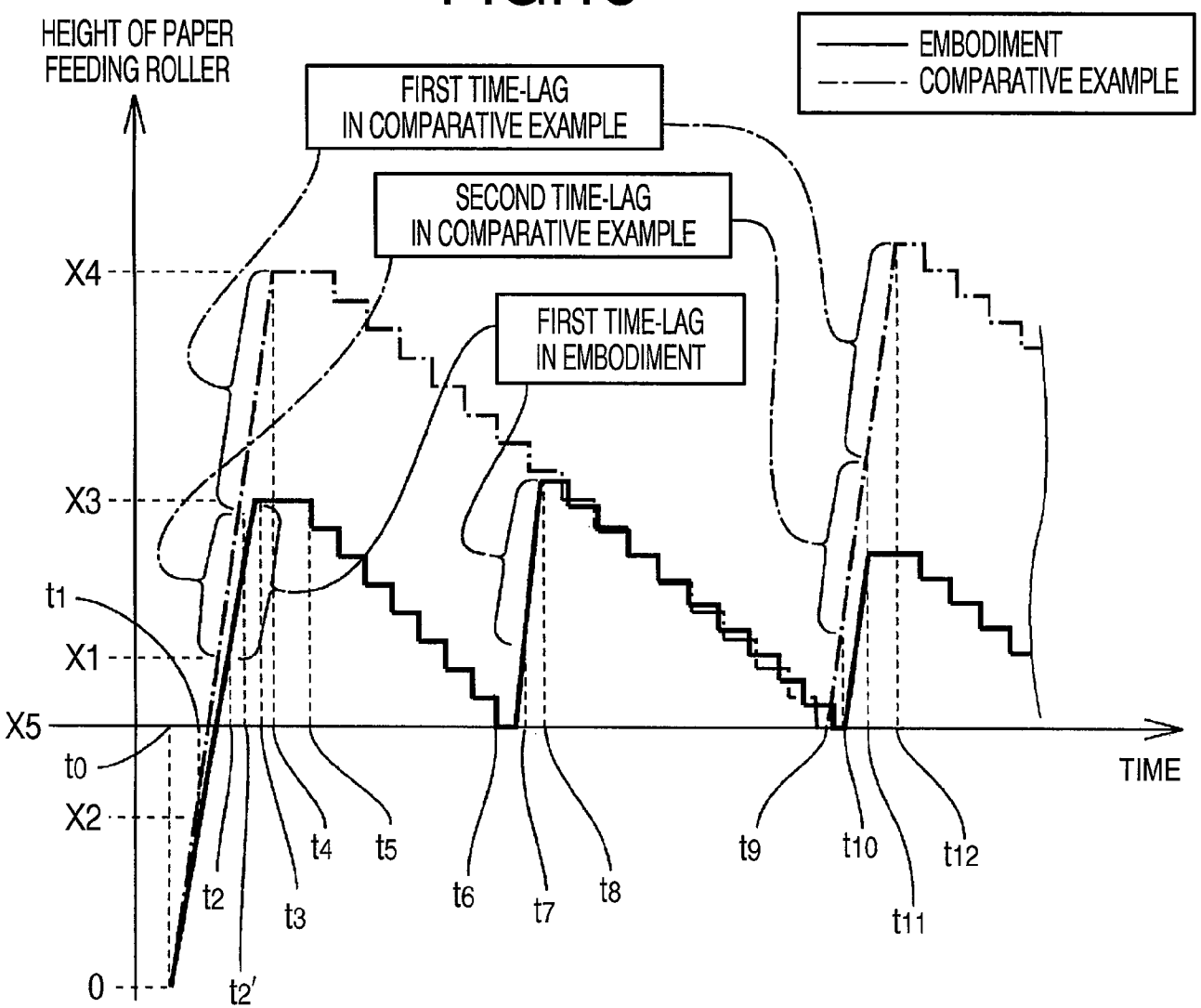

FIG. 15 shows time dependency of height of the sheet feeding roller in each the embodiment according to one or more aspects of the present invention and the comparative example.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings. It is noted that, in each drawing, an outline arrow denotes a direction in which a sheet feeding roller 9 or each gear is moved or rotated.

(Overall Configuration in Embodiment)

Figure 1:
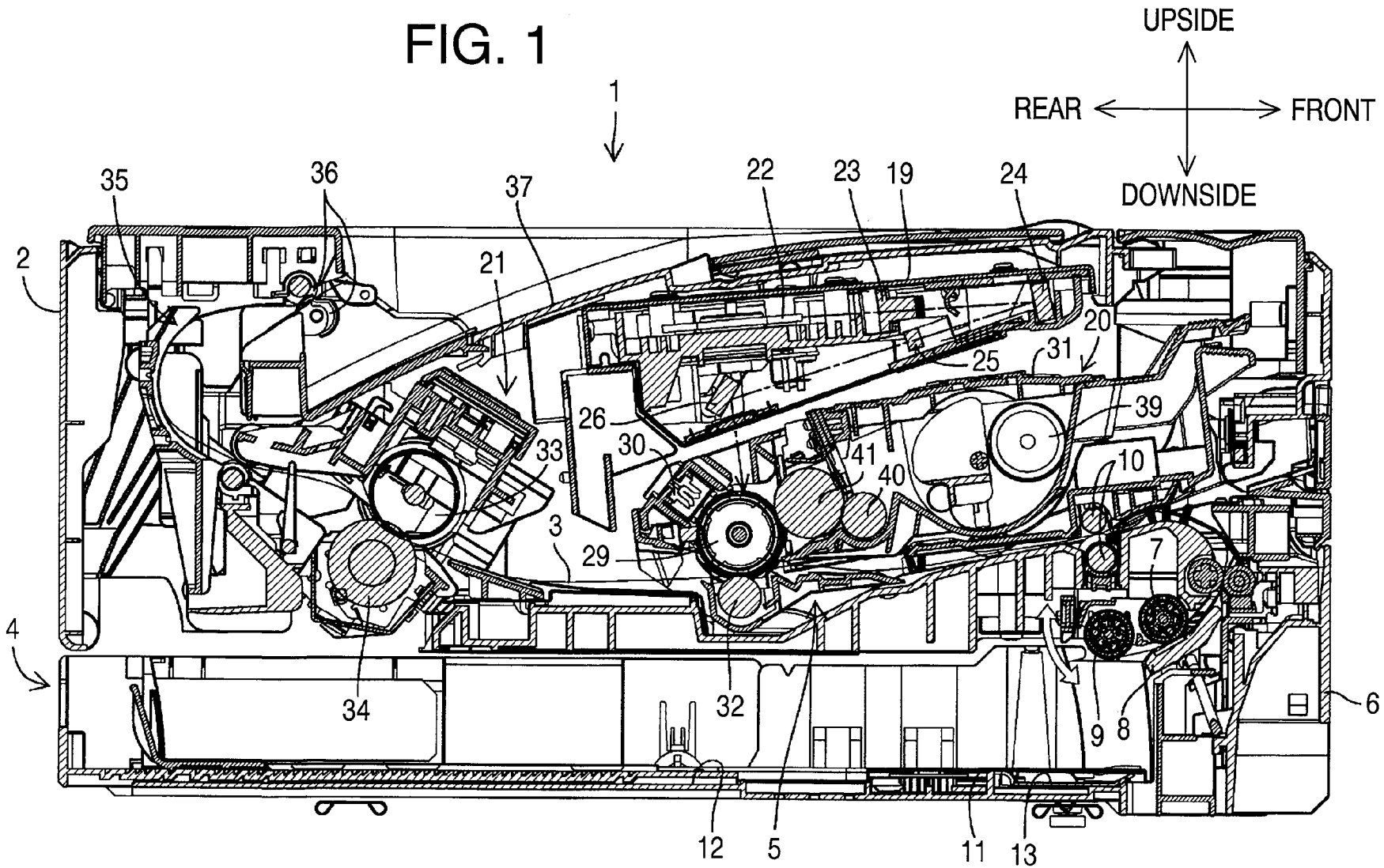
FIG. 1 is a cross-sectional side view showing a configuration of a laser printer in an embodiment according to one or more aspects of the present invention.
Figure 2:
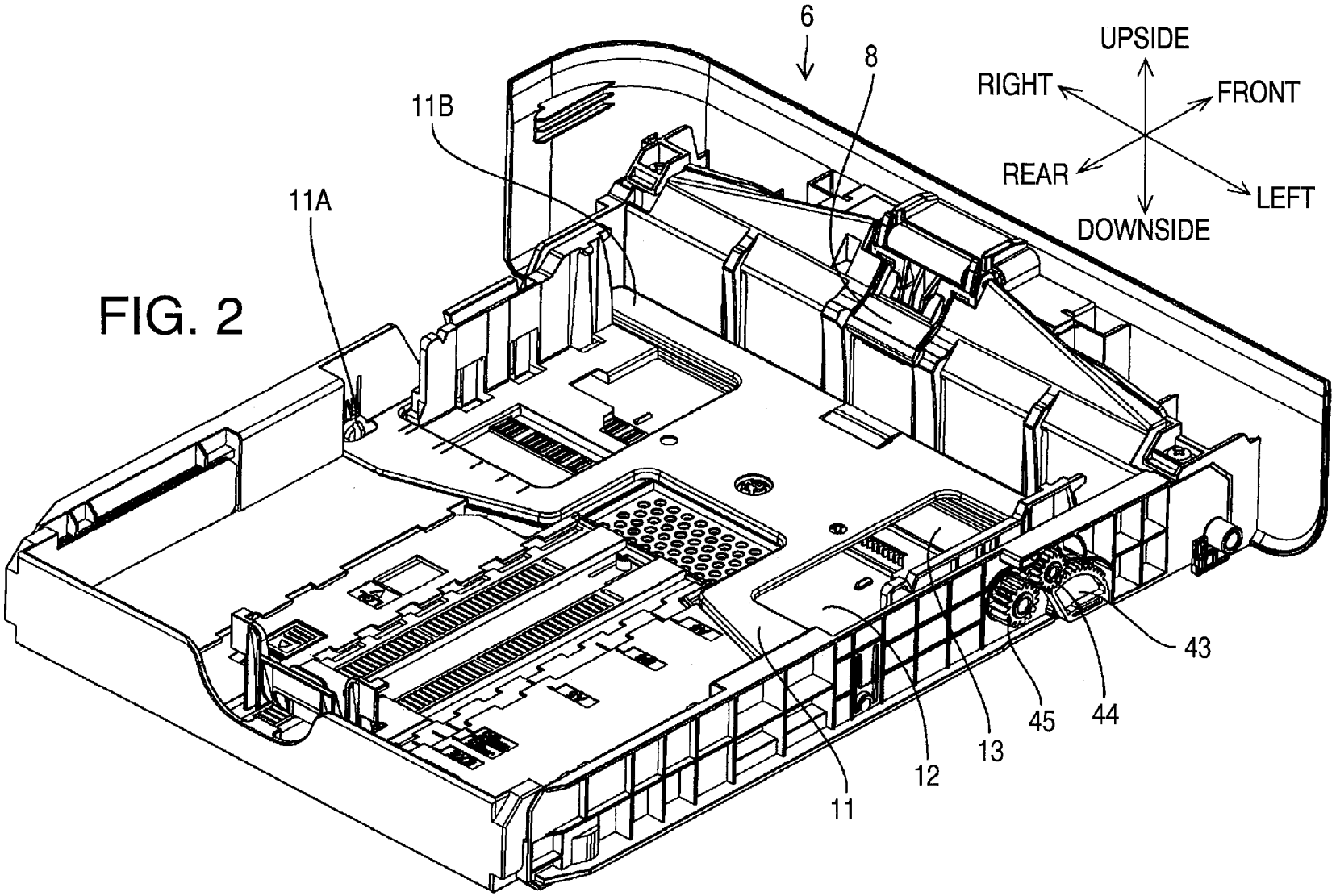
FIG. 2 is a perspective view of a storage cassette of the laser printer in the embodiment according to one or more aspects of the present invention.
Figure 3:
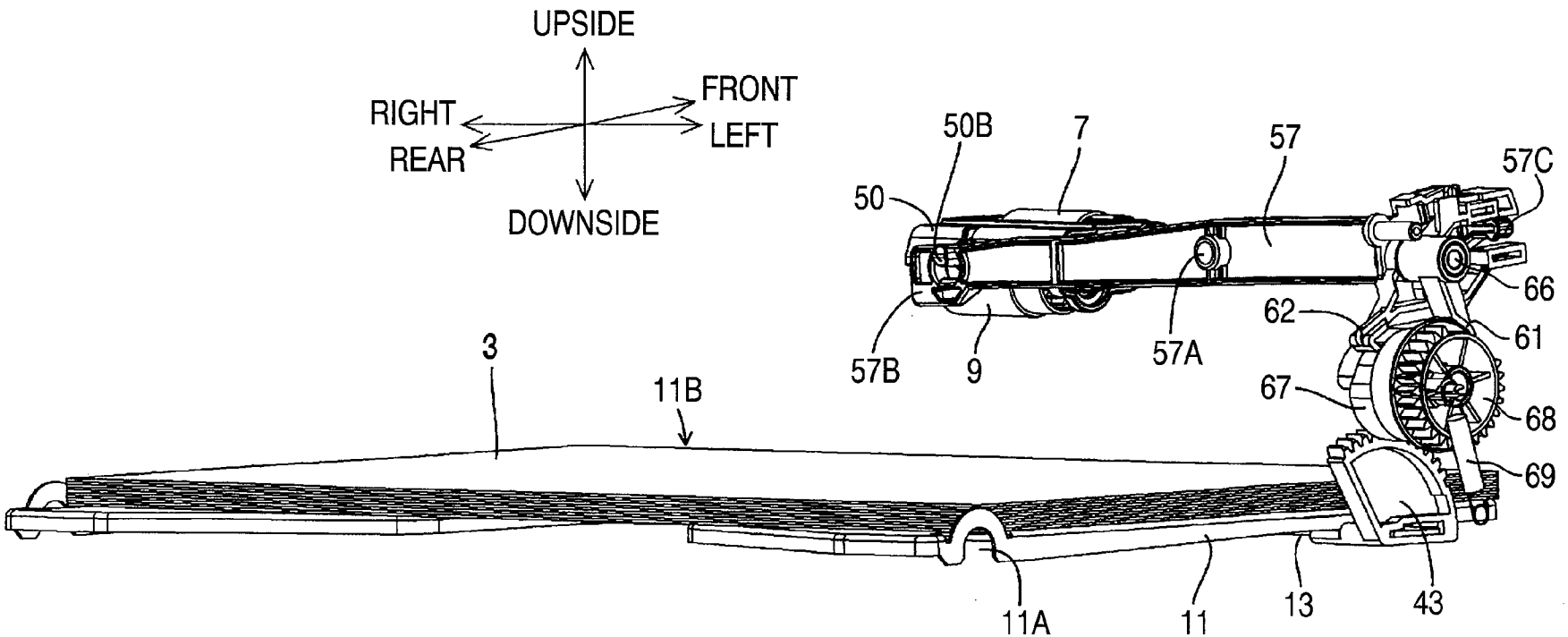
FIG. 3 is a perspective view showing a mechanism for lifting a pressing plate in a case where the pressing plate is in a sheet loading state in the embodiment according to one or more aspects of the present invention.
Figure 4:
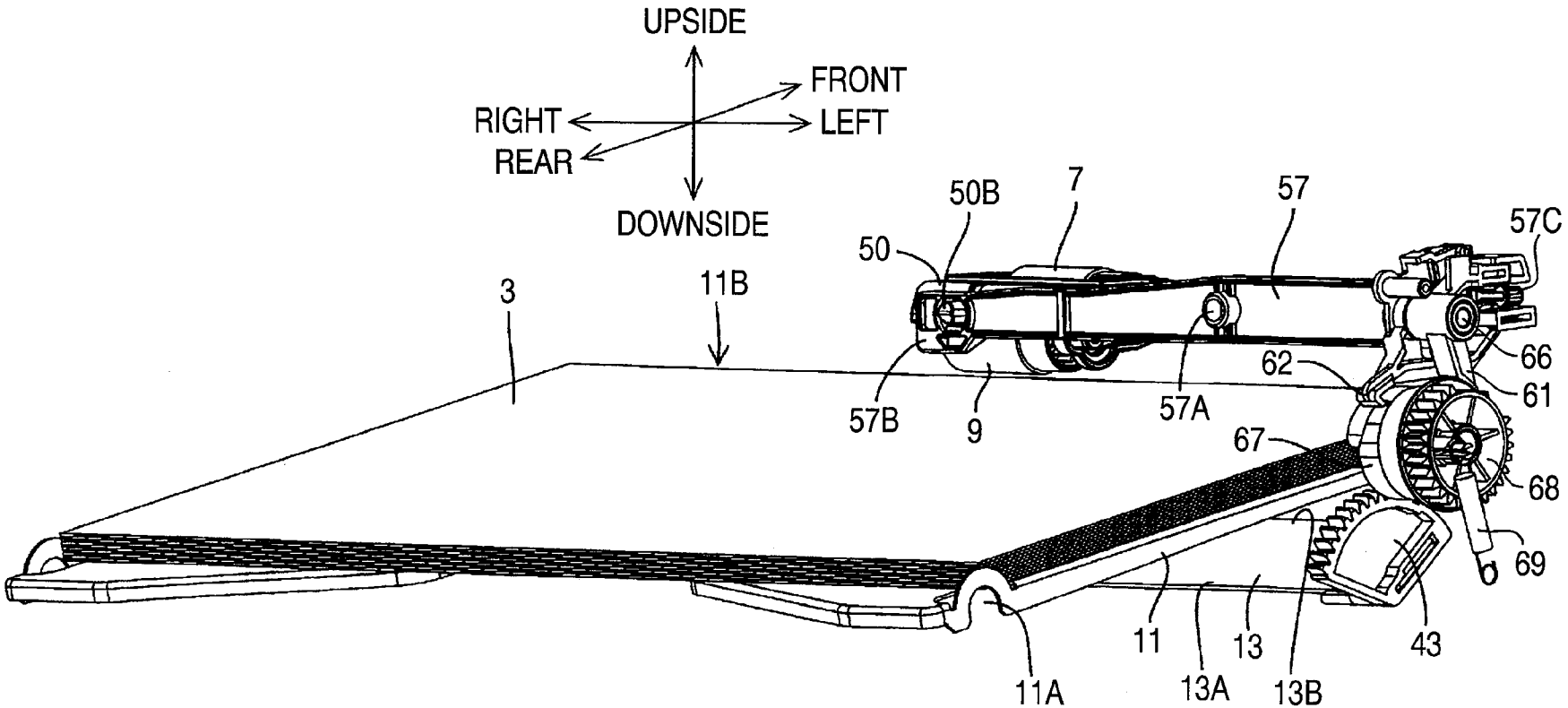
FIG. 4 is a perspective view showing the mechanism for lifting the pressing plate in a case where the pressing plate is between the sheet loading state and a sheet feeding state in the embodiment according to one or more aspects of the present invention.
Figure 5:
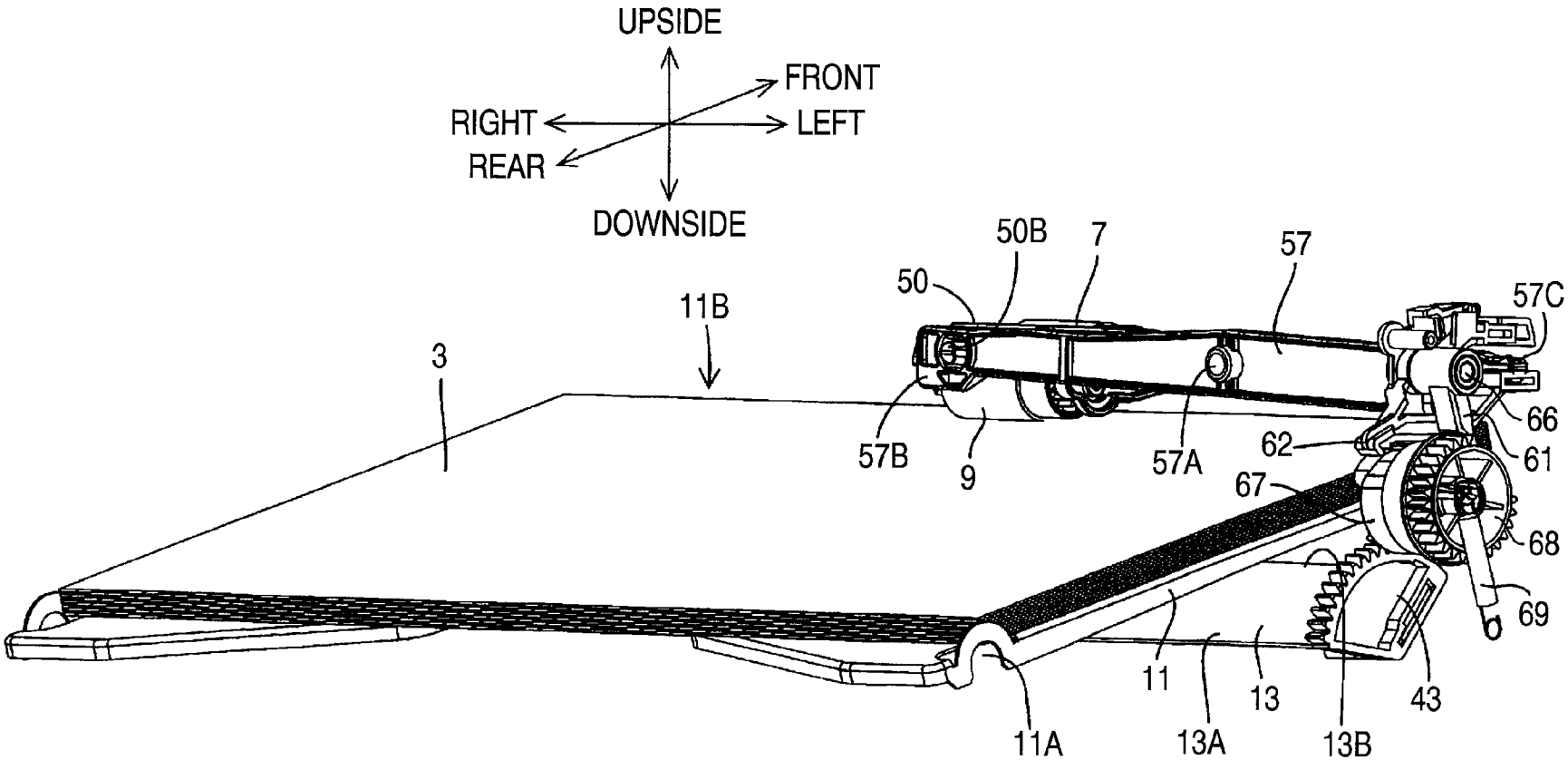
FIG. 5 is a perspective view showing the mechanism for lifting the pressing plate in a case where the pressing plate is in the sheet feeding state in the embodiment according to one or more aspects of the present invention.

FIG. 1 is a cross-sectional side view showing a configuration of a laser printer 1 (hereinafter, simply referred to as a printer 1). FIG. 2 is a perspective view of a storage cassette 6. FIGS. 3 to 5 are perspective views showing respective states in process of lifting a pressing plate 11.

The printer 1 is provided with a main body casing 2, a feeder unit 4 configured to feed a sheet 3, and an image forming unit 5 configured to form an image on the sheet 3.

1. Feeder Unit

The feeder unit 4 is provided at a bottom portion in the main body casing 2, and provided with a storage cassette 6 set therein to be drawn. In a following description, a side to which the storage cassette 6 is drawn is defined as a front side of the printer 1. The feeder unit 4 further includes a separation roller 7 and a separation pad 8 provided at an upper front portion of the storage cassette 6, and a sheet feeding roller 9 provided at a rear side of the separation roller 7 (at an upstream side of the separation pad 8 in a carrying direction in which the sheet 3 is conveyed).

The carrying route is fold back in a U-shape at a downstream side of the separation roller 7 and separation pad 8 in the carrying direction. At a further downstream side in the carrying direction, a pair of registration rollers 10 is provided.

As shown in FIGS. 1 and 2, a pressing plate 11 on which the sheet 3 is placed in an accumulated manner is provided inside the storage cassette 6. The pressing plate 11 is supported at a supporting portion 11A at a rear end thereof, swingably between a sheet loading state where a front end portion 11B of the pressing plate 11 is disposed at a lower side and the pressing plate 11 is along a bottom plate 12 of the storage cassette 6 (as shown in FIGS. 1 to 3) and a sheet feeding state where the front end portion 11B of the pressing plate 11 is disposed at an upper side and the pressing plate 11 is tilted up from the bottom plate 12 of the storage cassette 6 (namely, a state where the sheet feeding roller 9 contacts the uppermost sheet 3 placed on the pressing plate 11 as shown in FIG. 5, and the sheet 3 is fed by the sheet feeding roller 9 being rotated).

In addition, at a front end portion of the storage cassette 6, a lever 13 is provided to lift up the front end portion 11B of the pressing plate 11. The lever 13 is disposed under the front end portion 11B of the pressing plate 11 and supported such that a rear end portion 13A of the lever 13 is swingable between a lying down state where a front end portion 13B of the lever 13 is lying down on the bottom plate 12 of the storage cassette 6 (as shown in FIGS. 1 to 3) and a tilted state where the front end portion 13B is lifting the pressing plate 11 (as shown in FIG. 5). When a rotational driving force is applied to the rear end portion 13A of the lever 13 in a clockwise direction of the figure, the lever 13 is rotated around the rear end portion 13A, and the front end portion 13B of the lever 13 lifts the front end portion 11B of the pressing plate 11 to set the pressing plate 11 in the sheet feeding state. At a side end of the lever 13, a fan-shaped gear 43 is fixed as shown in FIG. 2. The gear 43 is linked, via a gear 44, with a linking gear 45 to which the driving force is transmitted from a driving source (not shown).

When the pressing plate 11 is set in the sheet feeding state, the uppermost sheet 3 placed on the pressing plate 11 is pressed by the sheet feeding roller 9, and sheet feeding is caused by rotation of the sheet feeding roller 9 to feed the sheet 3 toward a separation position between the separation roller 7 and separation pad 8.

Meanwhile, when the storage cassette 6 is drawn from the feeder unit 4, the linkage of the driving source (not shown) with the linking gear 45 is released. Then, the pressing plate 11 is set into the sheet loading state where a user can place the sheet 3 on the pressing plate 11 in an accumulated manner, with the front end portion 11B thereof moving down due to its own weight. It is noted that the separation pad 8, pressing plate 11, and lever 13 are disposed in the storage cassette 6, and that the sheet feeding roller 9, separation roller 7, registration rollers 10 are disposed in the main body casing 2.

When the sheet 3 is fed by the sheet feeding roller 9 toward the separation position and pinched in the separation position between separation roller 7 and separation pad 8, the sheet 3 is separated and fed on a sheet-by-sheet basis. The sheet 3 as fed is turned down along the U-shaped carrying route and conveyed to the registration rollers 10.

The registration rollers 10 are configured to adjust skewing of the sheet 3 and then convey the sheet 3 into a transfer position between a below-mentioned photoconductive drum 29 and transfer roller 32, where a toner image on the photoconductive drum 29 is transferred onto the sheet 3.

2. Image Forming Unit

The image forming unit 5 is provided with a scanner unit 19, a process cartridge 20, and a fixing unit 21. The scanner unit 19 is provided at an upper portion inside the main body casing 2. A laser light source (not shown) emits a laser beam based upon image data. As indicated by a chain line in FIG. 1, the laser beam is deflected by a polygon mirror 22, transmitted through an fθ lens 23, bent by a reflective mirror 24, transmitted through a lens 25, and bent downward by a reflective mirror 26. Thereby, the laser beam is incident onto a surface of the below-mentioned photoconductive drum 29 of the process cartridge 20.

The process cartridge 20 is provided under the scanner unit 19, and includes, in a housing thereof, the photoconductive drum 29, a scorotron-type charger 30, a development cartridge 31, and the transfer roller 32. In addition, the development cartridge 31 includes a toner container 39, a toner supply roller 40, and a development roller 41.

Toner provided from the toner container 39 is supplied to the development roller 41 through rotation of the toner supply roller 40. At this time, the toner is positively friction-charged between the toner supply roller 40 and the development roller 41. The toner supplied onto the development roller 41 is held on the development roller 41 as a thin layer with a constant thickness.

First, the surface of the photoconductive drum 29 is evenly and positively charged by the charger 30 through rotation of the photoconductive drum 29. Thereafter, the surface of the photoconductive drum 29 is exposed by fast scanning of the laser beam emitted from the scanner unit 19, and an electrostatic latent image corresponding to an image to be formed on the sheet 3 is formed thereon.

Subsequently, the toner held on the development roller 41 is supplied to the electrostatic latent image formed on the surface of the photoconductive drum 29, namely, exposed portions on the photoconductive drum 29 as evenly and positively charged that have been exposed by the laser beam to have a lowered electric potential, when facing and contacting the photoconductive drum 29 through rotation of the development roller 41. Thereby, the electrostatic latent image formed on the photoconductive drum 29 is visualized with the toner image due to inversion development being held on the photoconductive drum 29.

After that, as shown in FIG. 1, the toner image held on the surface of the photoconductive drum 29 is transferred onto the sheet 3 by a transfer bias applied to the transfer roller 32 while the sheet 3 conveyed by the registration rollers 10 is passing through the transfer position between the photoconductive drum 29 and the transfer roller 32. The sheet 3 with the toner image transferred thereon is carried to the fixing unit 21. The fixing unit 21 thermally fixes the toner transferred onto the sheet 3 in the transfer position while the sheet 3 is passing through between a heating roller 33 and pressing roller 34. The sheet 3 with the toner fixed thereon is conveyed to a sheet discharge path 35 extending toward the upper face of the main body casing 2 along a vertical direction. The sheet 3 carried to the sheet discharge path 35 is discharged, by a sheet discharge roller 36 provided above the sheet discharge path, onto a catch tray 37 formed on the upper face of the main body casing 2.

(Configurations of Sheet Feeding Roller and Separation Roller)

Figure 6:
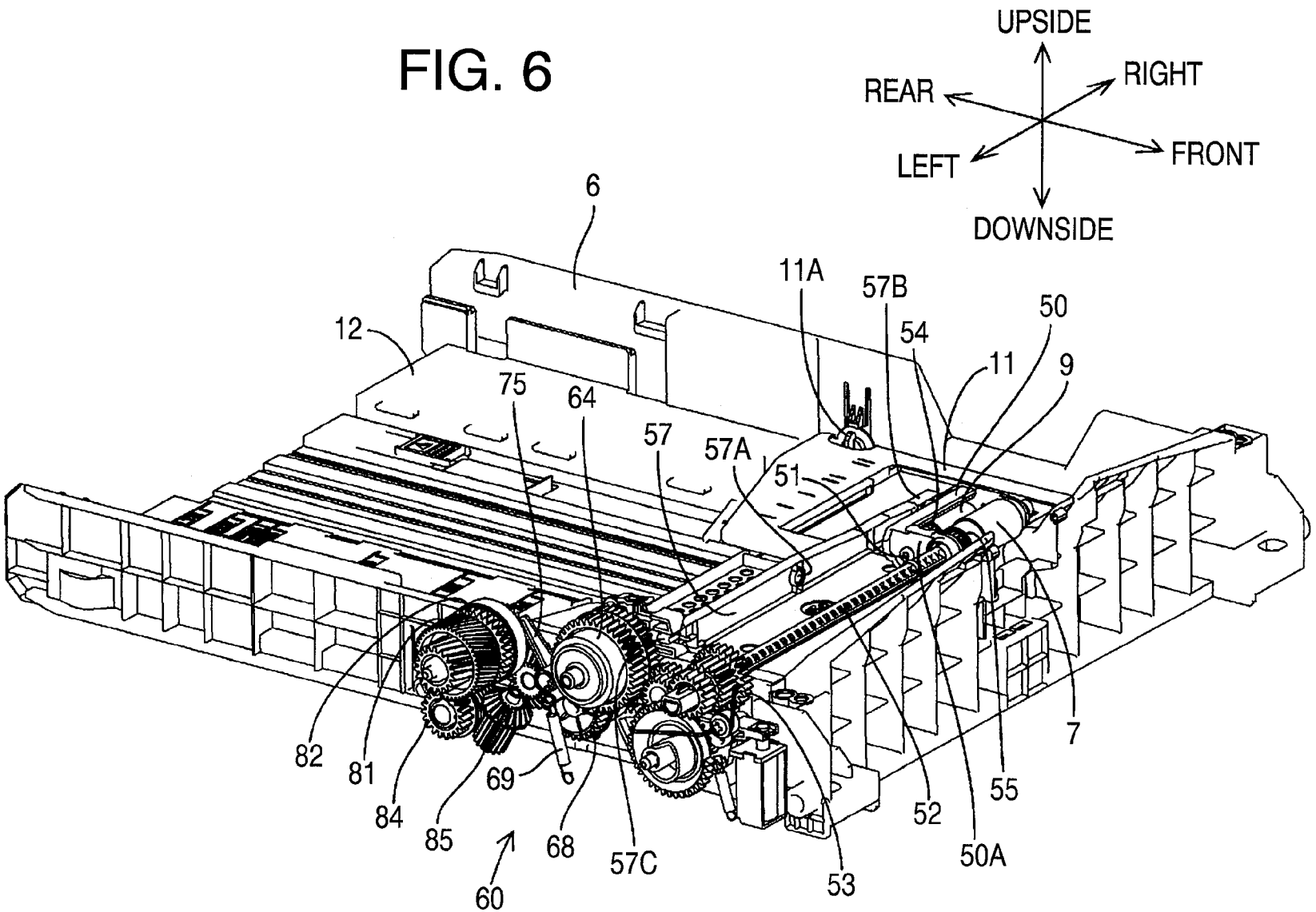
FIG. 6 is a perspective view of a gear mechanism viewed from a left side of the laser printer in the embodiment according to one or more aspects of the present invention.

FIG. 6 is a perspective view of a gear mechanism 60 viewed from a front side of the printer.

Figure 7:
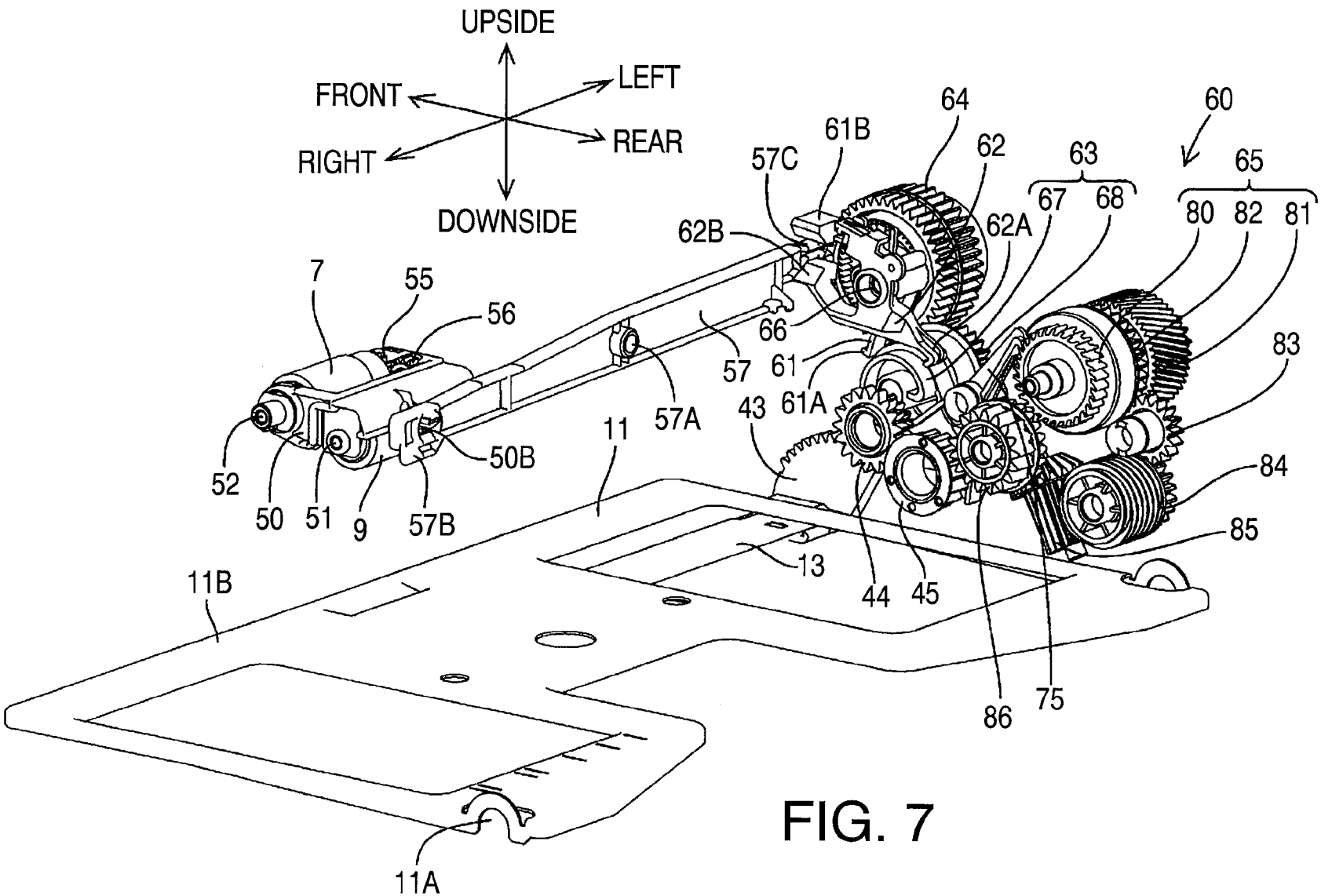
FIG. 7 is a perspective view of the gear mechanism viewed from a right side of the laser printer in the embodiment according to one or more aspects of the present invention.

FIG. 7 is a perspective view of the gear mechanism 60 viewed from a rear side of the printer.

As shown in FIG. 6, the sheet feeding roller 9 and the separation roller 7 are provided to a bearing member 50 so as to be aligned in a front-to-rear direction of the printer 1. Specifically, the sheet feeding roller 9 and the separation roller 7 are borne by the bearing member 50 via rotational shaft bodies 51 and 52 along a right-to-left direction, respectively. One end of the rotational shaft body 52 of the separation roller 7 penetrates a side wall portion 50A provided at a left side of the bearing member 50. Further, a separation roller gear 53 is provided at a distal end portion of the rotational shaft body 52 so as to be rotated integrally with the rotational shaft body 52. When the separation roller gear 53 receives a driving force from a below-mentioned gear mechanism 60, the rotational shaft body 52 is rotated, and thereby the separation roller 7 is rotated integrally with the rotational shaft body 52.

Additionally, the bearing member 50 is configured such that a portion thereof at a side of the sheet feeding roller 9 can be swung around the rotational shaft body 52 of the separation roller 7 (along a direction indicated by an outline double-sided arrow in FIG. 1). While the pressing plate 11 is lifted with the lever 13 being turned, the sheet feeding roller 9 contacts a surface of the uppermost sheet 3 of sheets placed on the pressing plate 11 from a lower side of the sheet feeding roller 9 and is swung up.

Additionally, gears 54 and 55, respectively rotating integrally with the rotational shaft bodies 51 and 52, are provided concentrically with the sheet feeding roller 9 and the separation roller 7, respectively. The gears 54 and 55 are linked via a linking gear 56. Thereby, the sheet feeding roller 9 is driven by the rotation of the separation roller 7.

As shown in FIG. 6, an arm member 57 with a center portion 57A thereof rotatably supported is provided in parallel with the rotational shaft body 52 at a rear side of the rotational shaft body 52. A hole provided at one end portion 57B of the arm member 57 is engaged with a protrusion 50B provided at a swingable end side of the bearing member 50 at which the sheet feeding roller 9 is provided. Further, the other end portion 57C of the arm member 57 is engaged with the gear mechanism 60.

(Configuration of Gear Mechanism)

The gear mechanism 60 is provided with a plurality of gears configured to be rotated by a driving force transmitted by a driving motor (not shown) provided at a main body casing 2 side. The gear mechanism 60 is configured to mainly control the lifting operation of the pressing plate 11 and the rotating operation of the separation roller 7.

Specifically, the gear mechanism 60 includes the aforementioned separation roller gear 53, a first engaging lever 61, a second engaging lever 62, a cam gear 63, and differential gears 64 and 65.

The first engaging lever 61 and second engaging lever 62 are arranged side by side in the right-to-left direction, and provided swingably around the same rotational shaft 66 extending along the right-to-left direction. The first engaging lever 61 and the second engaging lever 62 are formed with locking claws 61A and 62A at rear sides thereof and arm portions 61B and 62B at front sides thereof, respectively. The arm portions 61B and 62B are provided so as to pinch the end portion 57C of the arm member 57 therebetween. Thereby, when the arm portions 61B and 62B are moved in response to a swing motion of the end portion 57C of the arm member 57, respective sides of the locking claws 61A and 62A of the first engaging lever 61 and second engaging lever 62 are swung.

The cam gear 63 is formed with a cam 67 and a tooth-lacking gear 68 being concentrically integrated. The cam 67 is formed such that a portion thereof corresponding to about one forth as long as an entire circumference of the cam 67 has a smaller radius than that of the other portion of the cam 67 (for example, see FIG. 8A). In addition, on an outer circumferential surface of the cam 67, there are formed a first engaged portion 71 configured to be engaged with the locking claw 61A of the first engaging lever 61 and a second engaged portion 72 configured to be engaged with the locking claw 62A of the second engaging lever 62. It is noted that the first engaged portion 71 is provided in a position slightly shifted from the second engaging lever 62 in the right-to-left direction so as to comply with the positional relationship between the first engaging lever 61 and second engaging lever 62.

Figure 8A:
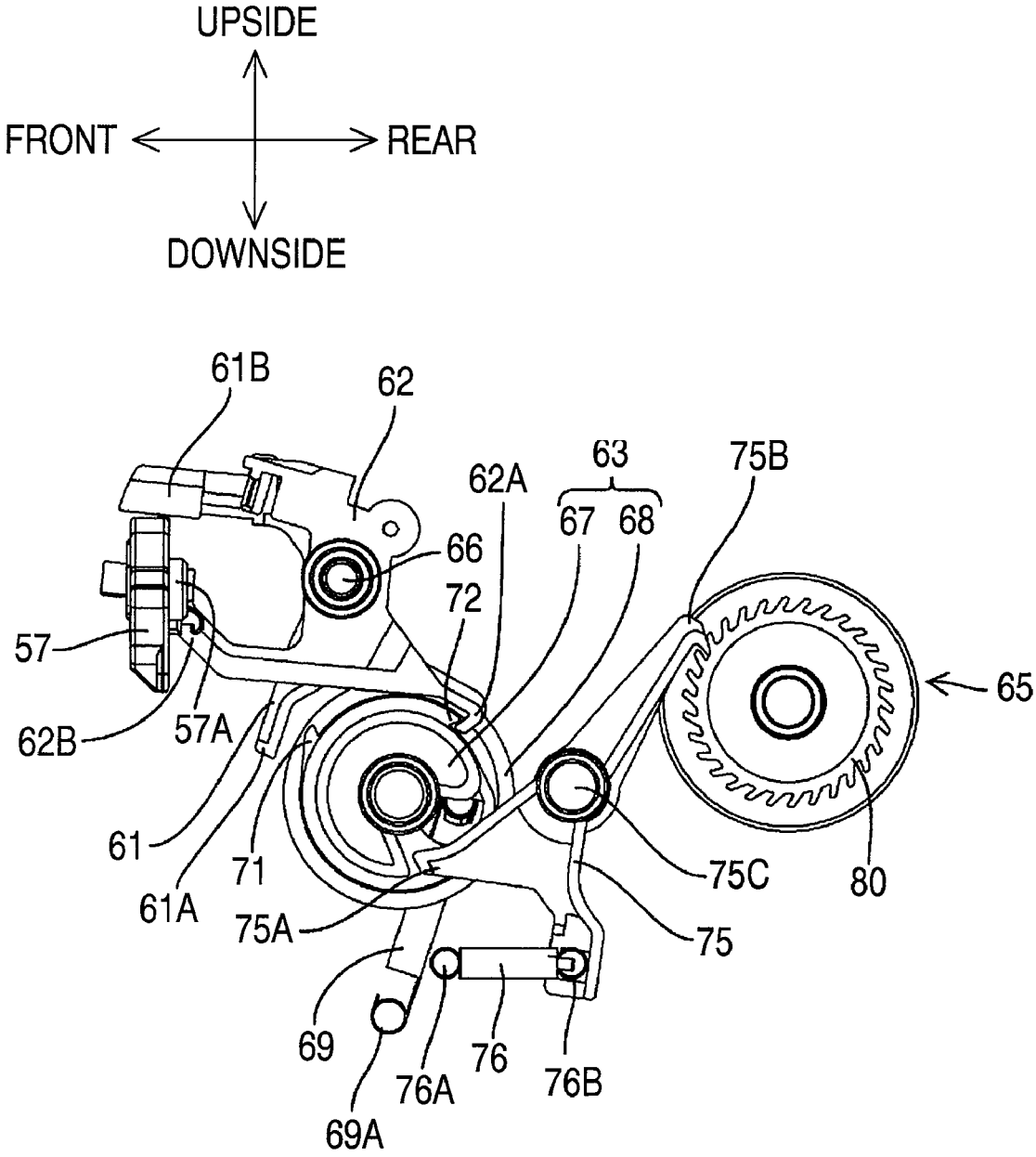
FIG. 8A is a right side view of the gear mechanism in the case where a sheet feeding roller is in the lowest position in the embodiment according to one or more aspects of the present invention.
Figure 8B:
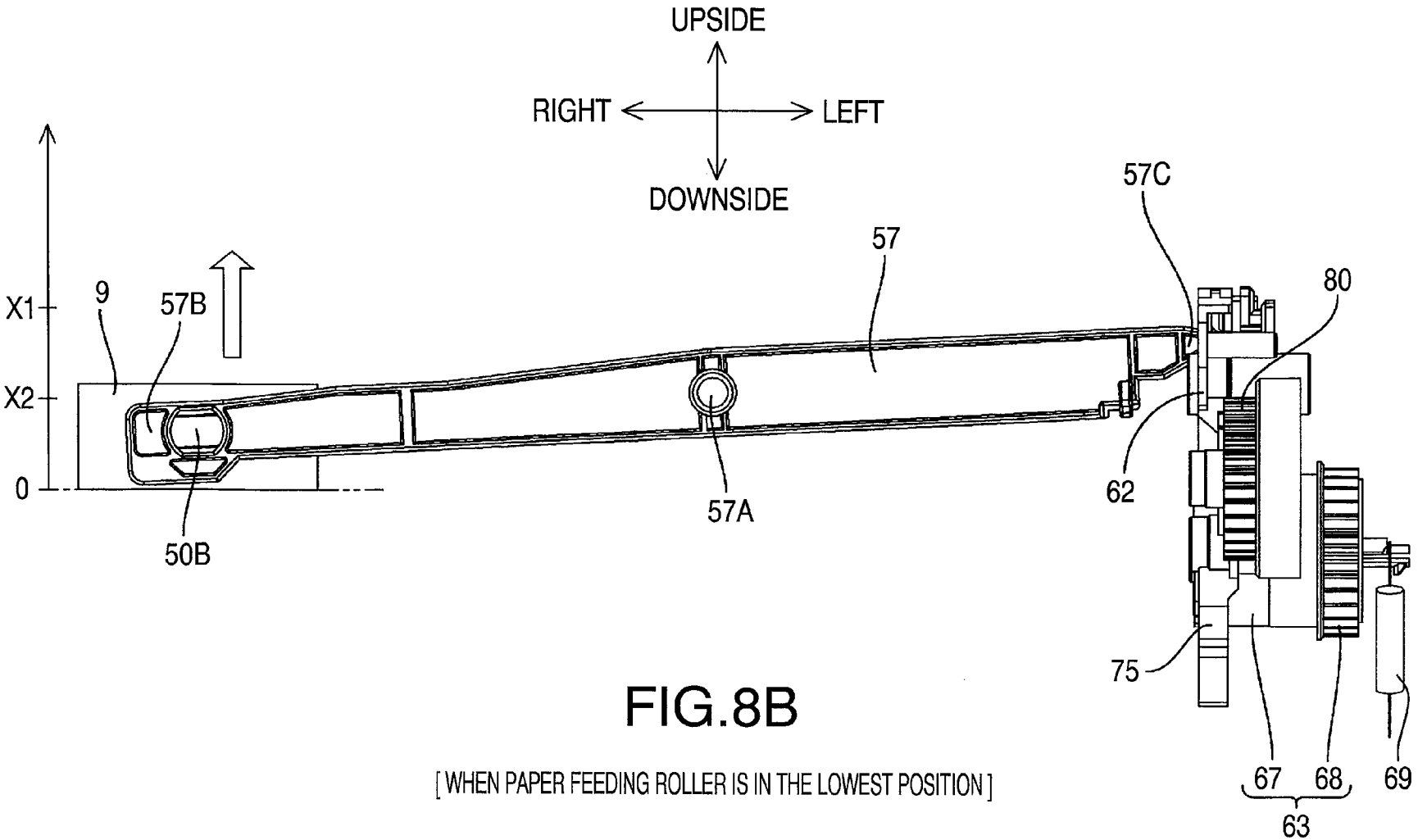
FIG. 8B is a rear side view of the gear mechanism in the case where the sheet feeding roller is in the lowest position in the embodiment according to one or more aspects of the present invention.
Figure 8C:
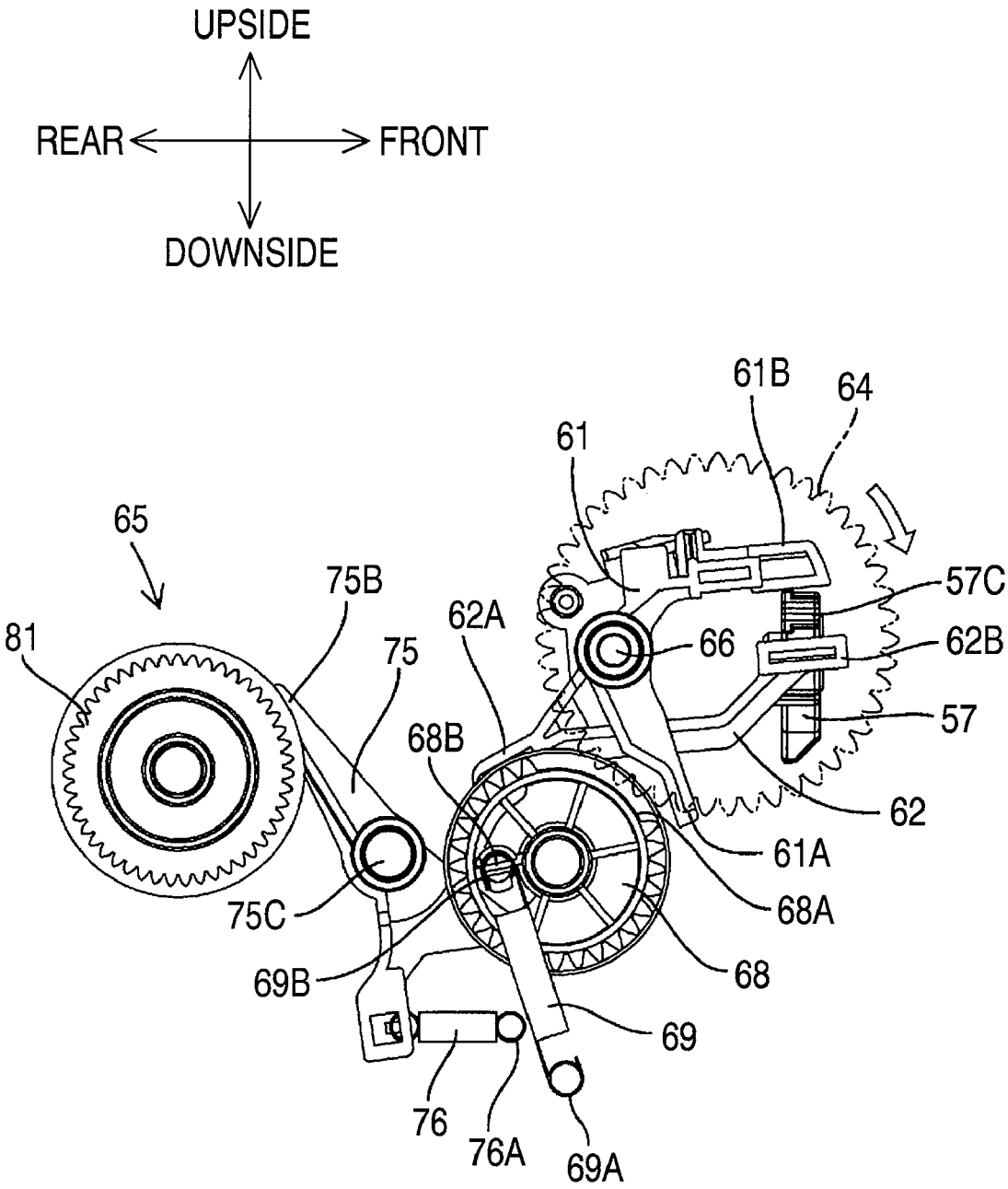
FIG. 8C is a left side view of the gear mechanism in the case where the sheet feeding roller is in the lowest position in the embodiment according to one or more aspects of the present invention.

As illustrated in FIG. 8C, the tooth-lacking gear 68 is provided with a tooth-lacking portion 68A with no tooth that corresponds to about one forth as long as an entire circumference of the tooth-lacking gear 68. Additionally, a lower end 69A of a spring 69 is fixed at a side of the main body casing 2, and a free end 69B of the spring 69 is hooked with a protrusion 68B protruded at a point off a rotational center of the tooth-lacking gear 68 in an axial direction of the tooth-lacking gear 68. The differential gear 64, which is configured to be rotated due to a driving force transmitted from a main motor (not shown), is provided in the vicinity of the tooth-lacking gear 68. The tooth-lacking gear 68 is rotated while teeth thereof are being engaged with the differential gear 64. Meanwhile, the tooth-lacking gear 68 is not driven and stopped while the tooth-lacking portion 68A thereof is facing the differential gear 64.

As shown in FIG. 8A, a switching tilting member 75 for taking ON/OFF control of the lifting operation for the pressing plate 11 is disposed behind the cam gear 63. The switching tilting member 75 is tiltably supported at a center portion thereof by a rotational shaft 75C extending along the right-to-left direction. The switching tilting member 75 includes a front end portion 75A that is configured to contact the outer circumferential surface of the cam 67, and a locking claw 75B that is integrally provided at a distal end of a rear end portion of the switching tilting member 75. Additionally, a spring 76 is formed with a front end 76A thereof being fixed at a side of the main body casing 2 and a free end 76B thereof being linked with a lower end of the switching tilting member 75. Thereby, the switching tilting member 75 is biased by the spring 76 in a clockwise direction of FIG. 8A.

The differential gear 65 is provided with a locked gear 80, an input gear 81, and an output gear 82. The locked gear 80 is disposed to be latched with the locking claw 75B of the switching tilting member 75. The input gear 81 is always driven and rotated by the driving force received from the main motor. The output gear 82 is in an idling state until the locked gear 80 is latched with the locking claw 75B of the switching tilting member 75. Meanwhile, in response to the locked gear 80 being latched with the locking claw 75B of the switching tilting member 75, the output gear 82 is driven and rotated in conjunction with the input gear 81. The output gear 82 is linked to a linking gear 86 via gears 83 to 85. The linking gear 86 is provided in such a position as to be linked with the linking gear 45 at a side of the storage cassette 6 in a state where the storage cassette 6 is inserted and attached into the feeder unit 4 (in a state shown in FIG. 1). On the other hand, when the storage cassette 6 is drawn out from the feeder unit 4, the linkage between the linking gears 45 and 86 is released, and thus, as described above, the pressing plate 11 is set into the sheet loading state, with the front end portion 11B thereof moving down due to its own weight.

(Operation of Gear Mechanism)

Next, operation of the gear mechanism 60 will be described with reference to FIGS. 8A to 12C. Each figure indicated by a number with a suffix "A" is a right side view of a part of the gear mechanism 60. Each figure indicated by a number with a suffix "B" is a rear side view of a part of the gear mechanism 60. Each figure indicated by a number with a suffix "C" is a left side view of a part of the gear mechanism 60.

1. Continuous Lifting Mode

The gear mechanism 60 continuously lifts the pressing plate 11 until the sheet feeding roller 9 reaches a second release position X2 from the lowest position O.

As described above, for example, when the storage cassette 6 is drawn out from the feeder unit 4, the pressing plate 11 is shifted in the sheet loading state due to its own weight. At this time, the sheet feeding roller 9 (the end portion 57B of the arm member 57, or strictly, a bottom face of the sheet feeding roller 9) is moved to the lowest position O as illustrated in FIG. 8B. Thereby, the arm member 57 is tilted like a seesaw, and on the contrary, the end portion 57C thereof is moved to the highest position. Thereafter, for example, when the storage cassette 6 is inserted and re-attached into the feeder unit 4 after the sheet 3 is re-supplied (see FIG. 3), the gear mechanism 60 is set into a state shown in FIGS. 8A and 8C. When the end portion 57C is moved up, the locking claw 61A of the first engaging lever 61 is spaced from the first engaged portion 71. Further, the locking claw 62A of the second engaging lever 62 is engaged with the second engaged portion 72 of the cam gear 63. Thereby, the rotation of the cam gear 63 is stopped against a biasing force of the spring 69. At this time, the tooth-lacking gear 68 is in a state where the tooth-lacking portion 68A faces the differential gear 64 and thus the driving force from the differential gear 64 is not transmitted to the tooth-lacking gear 68.

Figure 9A:
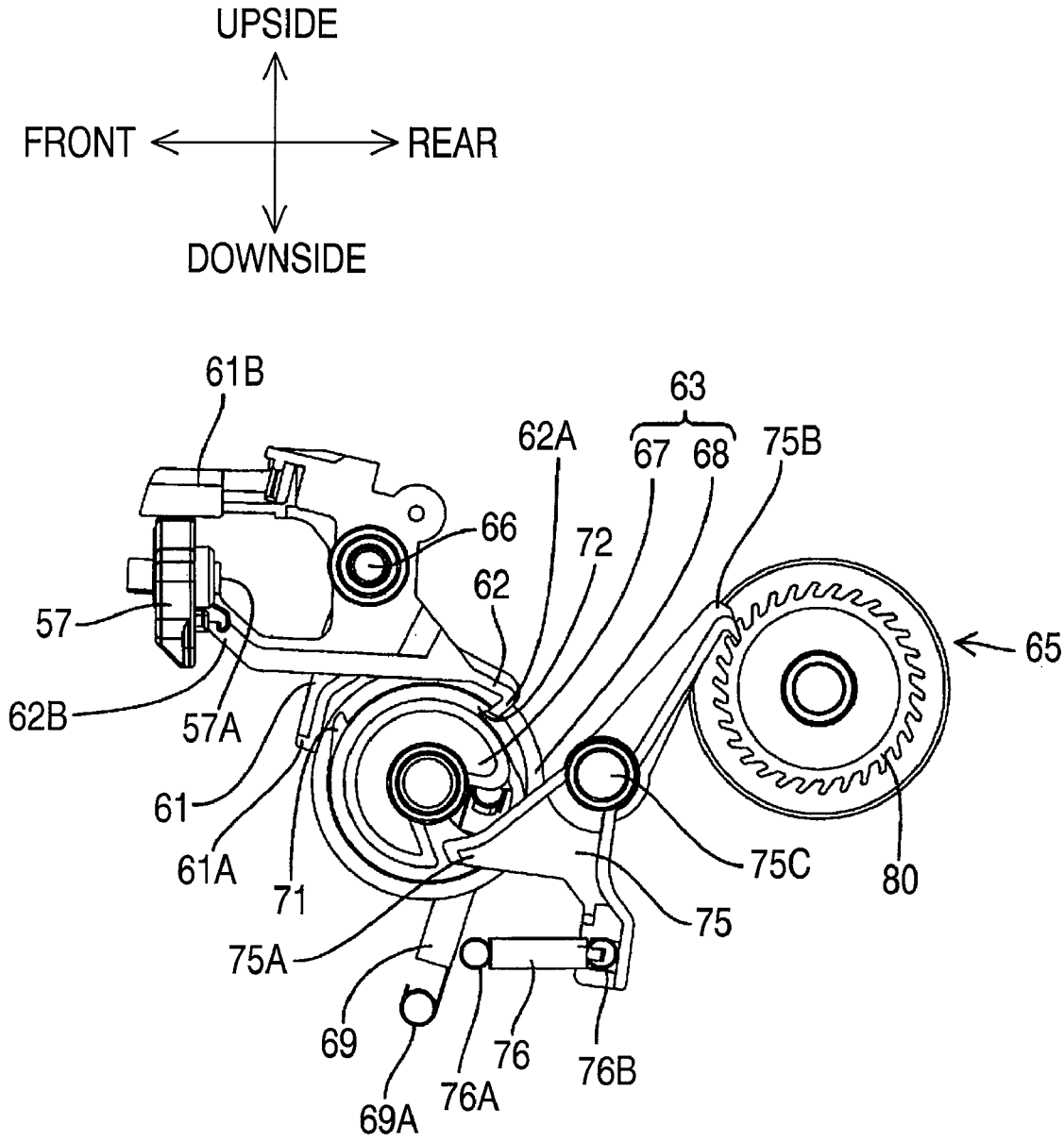
FIG. 9A is a right side view of the gear mechanism in a case where the sheet feeding roller is in a second release position in the embodiment according to one or more aspects of the present invention.
Figure 9B:
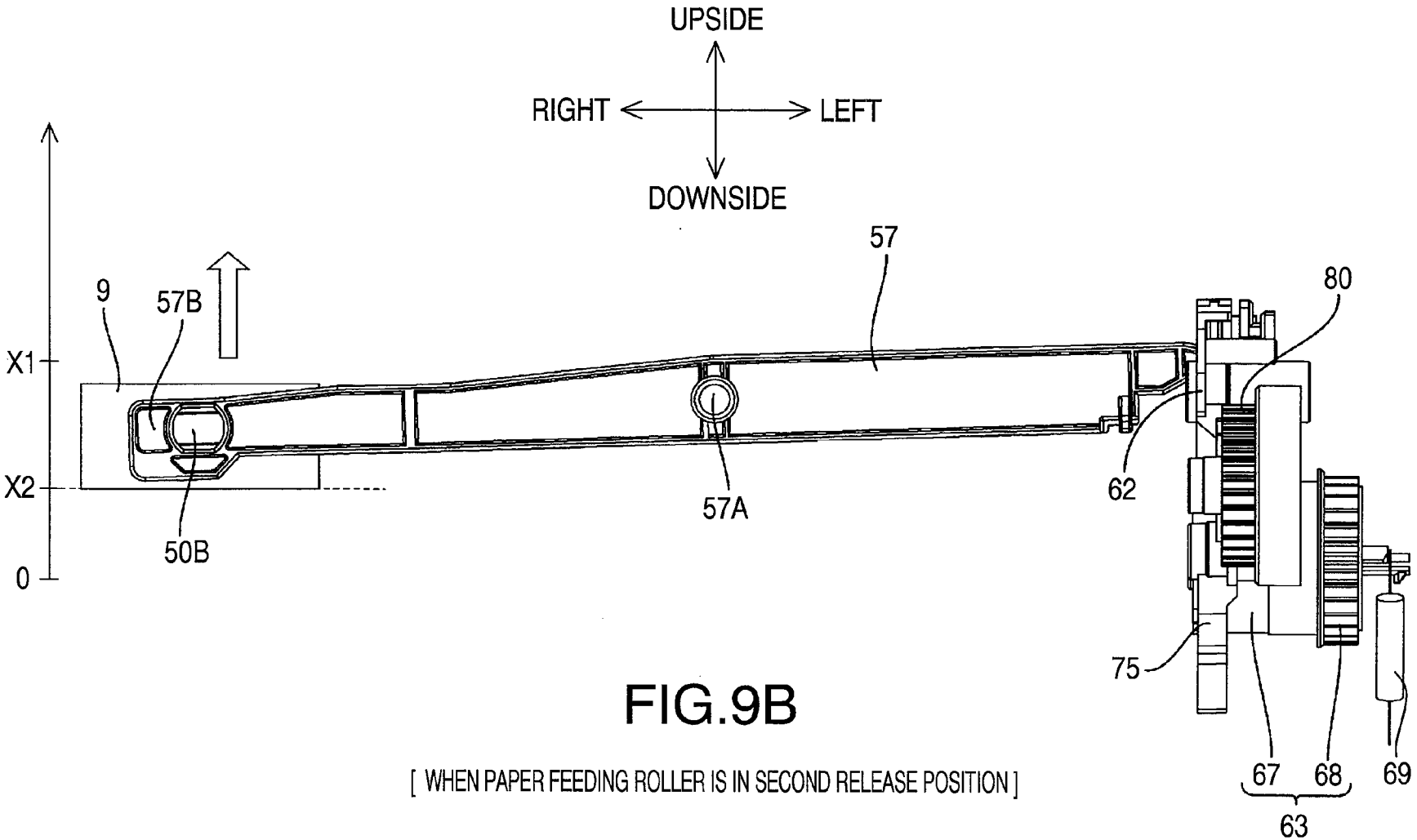
FIG. 9B is a rear side view of the gear mechanism in the case where the sheet feeding roller is in the second release position in the embodiment according to one or more aspects of the present invention.
Figure 9C:
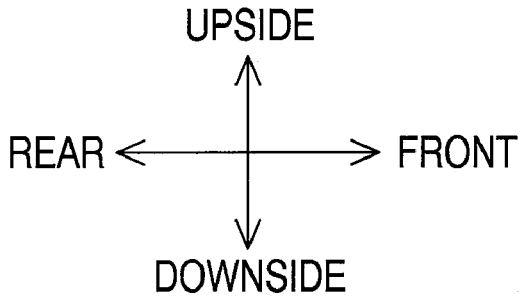
FIG. 9C is a left side view of the gear mechanism in the case where the sheet feeding roller is in the second release position in the embodiment according to one or more aspects of the present invention.
Figure 9C:
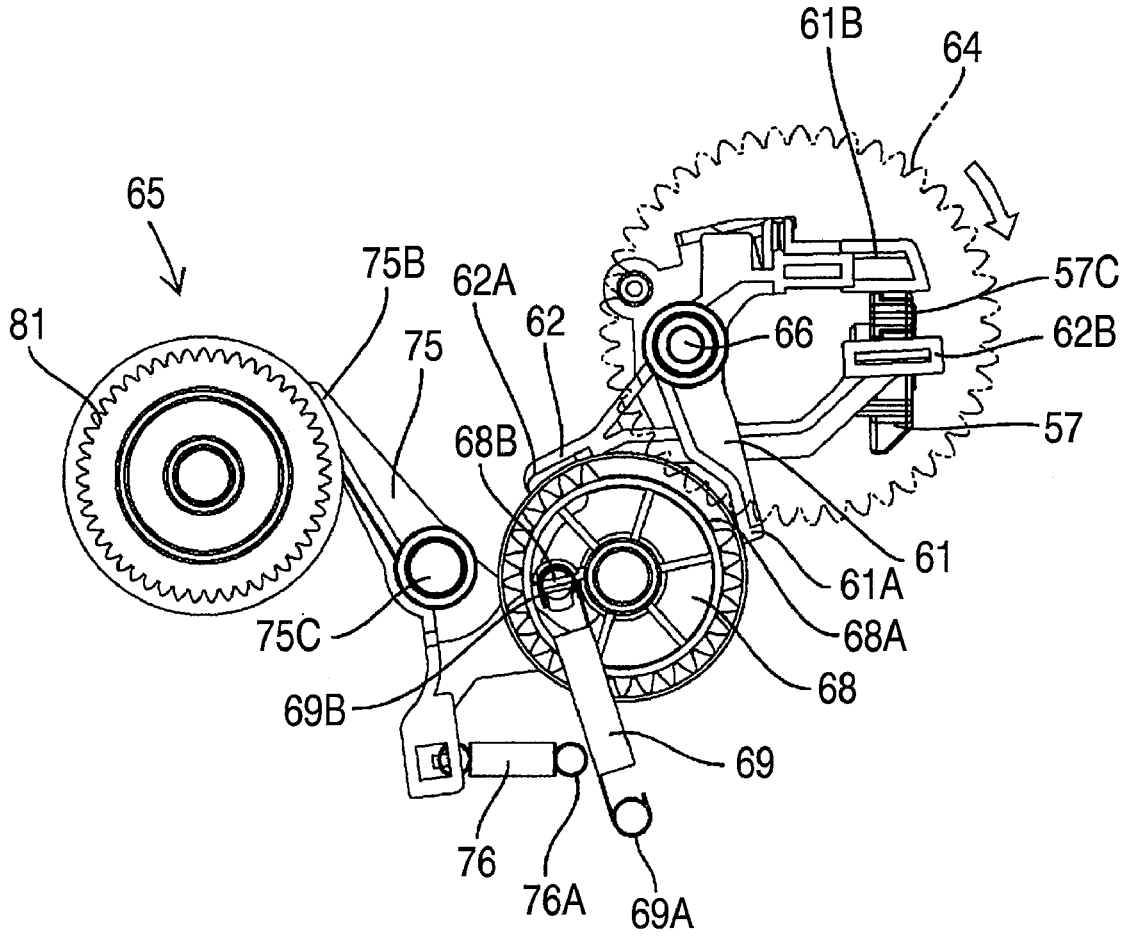

In addition, since the front end portion 75A of the switching tilting member 75 is within the smaller-radius portion of the cam 67, the locking claw 75B is latched with the locked gear 80 owing to a biasing force of the spring 76. Thereby, in accordance with a mechanical property of the differential gear 65, the output gear 82 is rotated and set into an operating state for lifting the pressing plate 11, while the locked gear 80 is stopped (a rotational position of the cam 67 shown in FIGS. 8A to 8C and 9A to 9C is defined as a first rotational position in the present embodiment). As illustrated in FIGS. 9A to 9C, the gear mechanism 60 maintains the operating state until the sheet feeding roller 9 reaches the second release position X2 from the lowest position O. Namely, during the operating state, the output gear 82 of the differential gear 65 is always rotated, and the pressing plate 11 is continuously lifted.

Specifically, when the pressing plate 11 is lifted to a certain height, the uppermost sheet 3 of sheets stacked on the pressing plate 11 contacts the sheet feeding roller 9. Thereby, the sheet feeding roller 9 is lifted up from the lowest position O along with the rising of the pressing plate 11 (see FIG. 5). When the sheet feeding roller 9 is lifted up, the end portion 57C of the arm member 57 is reversely moved down so as to move the first engaging lever 61 and the second engaging lever 62, which are disposed to pinch the end portion 57C therebetween. Then, when the sheet feeding roller 9 reaches the second release position X2 (see FIG. 9B), the second engaging lever 62 is disengaged from the second engaged portion 72 as shown in FIG. 9A.

2. Intermittent Lifting Mode

Figure 10A:
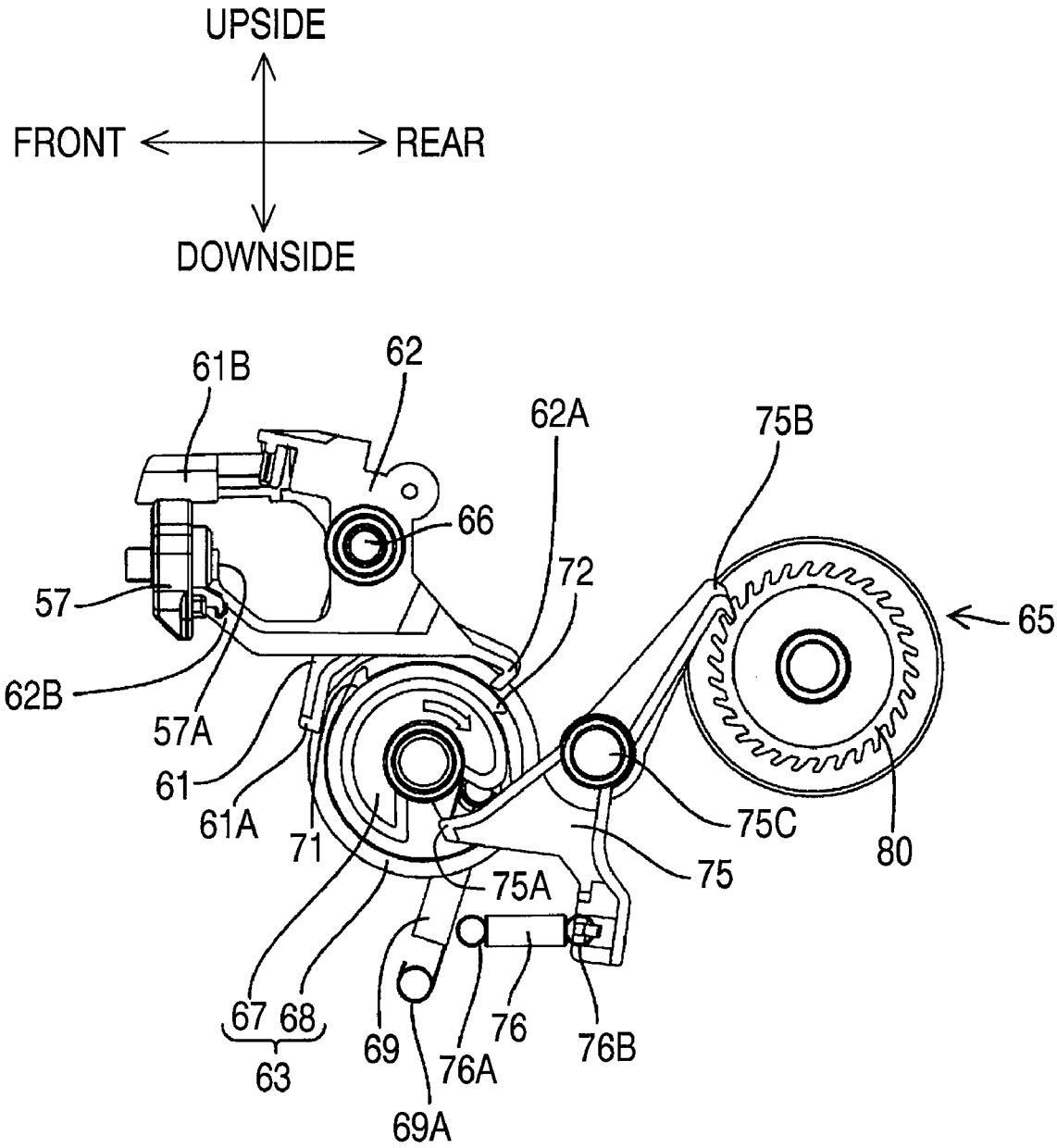
FIG. 10A is a right side view of the gear mechanism in a case where a cam gear is engaged with a differential gear in the embodiment according to one or more aspects of the present invention.
Figure 10B:
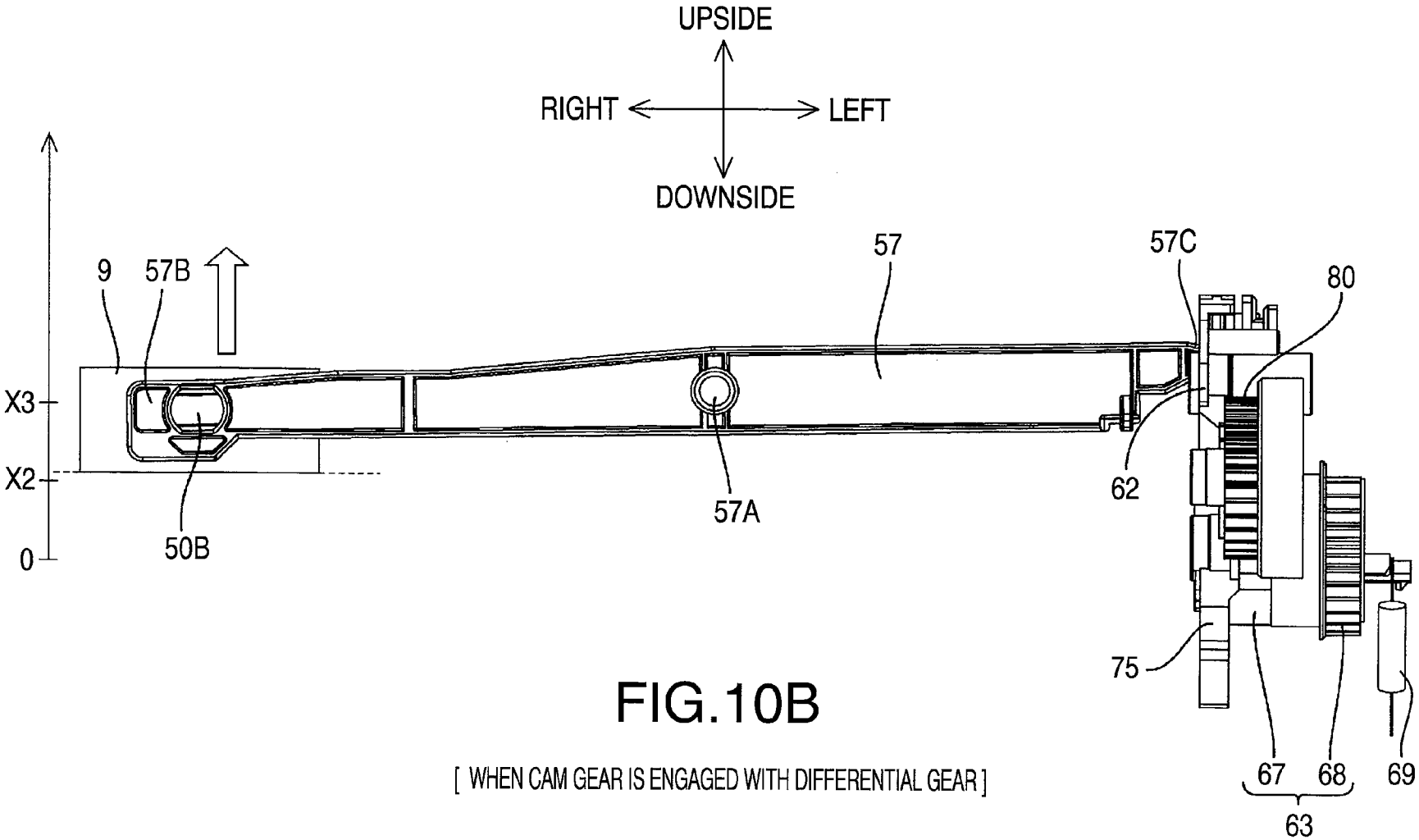
FIG. 10B is a rear side view of the gear mechanism in the case where the cam gear is engaged with the differential gear in the embodiment according to one or more aspects of the present invention.
Figure 10C:
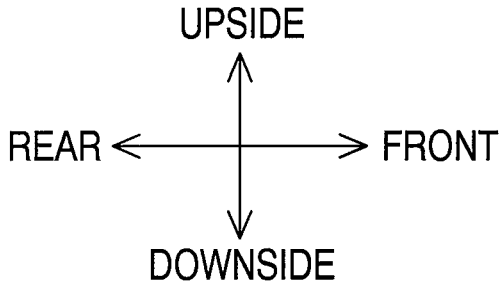
FIG. 10C is a left side view of the gear mechanism in the case where the cam gear is engaged with the differential gear in the embodiment according to one or more aspects of the present invention.
Figure 10C:
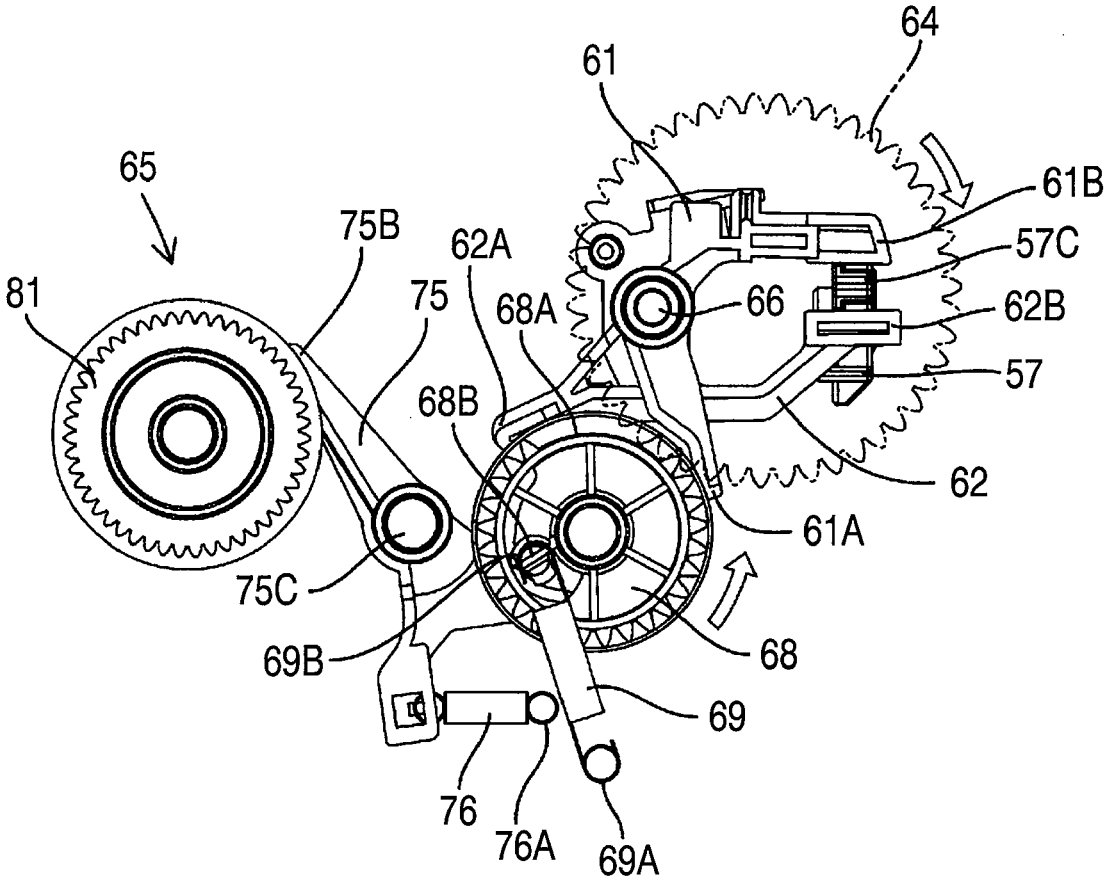

Subsequently, when the second engaging lever 62 is disengaged from the second engaged portion 72, the operation of the gear mechanism 60 shifts to an intermittent lifting mode from the continuous lifting mode. Specifically, the cam gear 63 is enforcedly rotated by the biasing force of the spring 69 in a counterclockwise of FIG. 9C. Then, as shown in FIG. 10C, the teeth of the tooth-lacking gear 68 of the cam gear 63 are engaged with the differential gear 64. Thereby, the cam gear 63 is driven by a driving force from the differential gear 64 in a counterclockwise direction of FIG. 10C. It is noted that, at this time, since the front end portion 75A of the switching tilting member 75 is still within the smaller-radius portion of the cam 67, the aforementioned operating state is maintained (see FIG. 10A), and the sheet feeding roller 9 is further lifted up (see FIG. 10B).

Thereafter, when the cam gear 63 is further rotated, the front end portion 75A of the switching tilting member 75 runs upon the larger-radius portion of the cam 67. Therefore, the switching tilting member 75 is rotated against the biasing force of the spring 76, in the counterclockwise of FIG. 10A, and the locking claw 75B is disengaged from the locked gear 80. Thereby, in accordance with a mechanical property of the differential gear 65, power transmission to the output gear 82 is stopped even while the locked gear 80 keeps its rotation. Thus, the gear mechanism 60 is set into a stopped state for stopping the rising of the pressing plate 11 from the aforementioned operating state.

The second engaging lever 62 is in a position away from the cam 67 and never engaged with the second engaged portion 72 whenever the sheet feeding roller 9 is positioned higher than the second release position X2. Accordingly, when the sheet feeding roller 9 is positioned higher than the second release position X2, the cam gear 63 alternately receives the driving force from the differential gear 64 and the biasing force of the spring 69 and keeps the rotation thereof as far as the first engaging lever 61 is not engaged with the first engaged portion 71. Thus, since the gear mechanism 60 alternately repeats the operating state and the stopped state, the pressing plate 11 is intermittently lifted up.

Figure 11A:
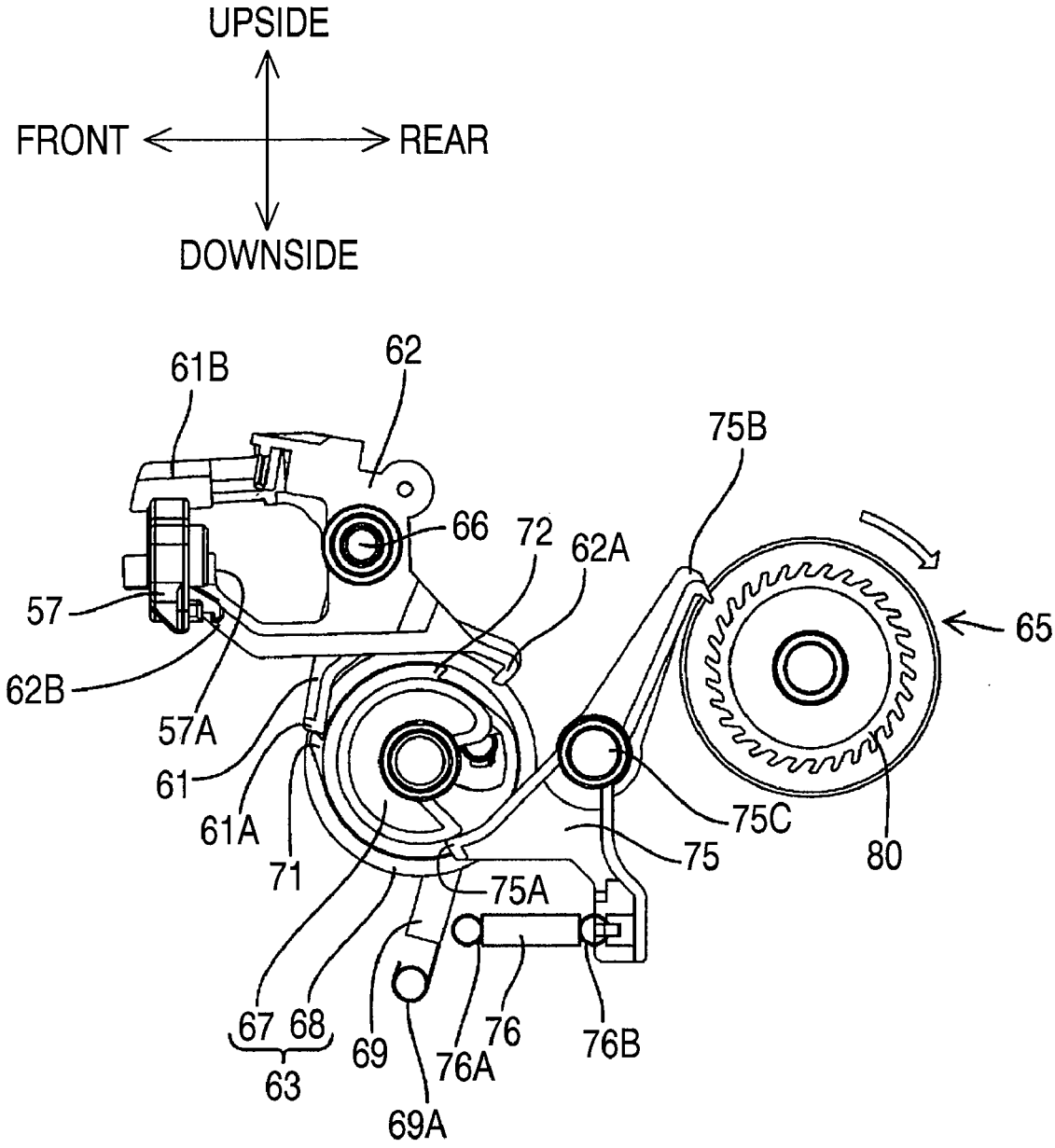
FIG. 11A is a right side view of the gear mechanism in a case where the sheet feeding roller is in a first release position in the embodiment according to one or more aspects of the present invention.
Figure 11B:
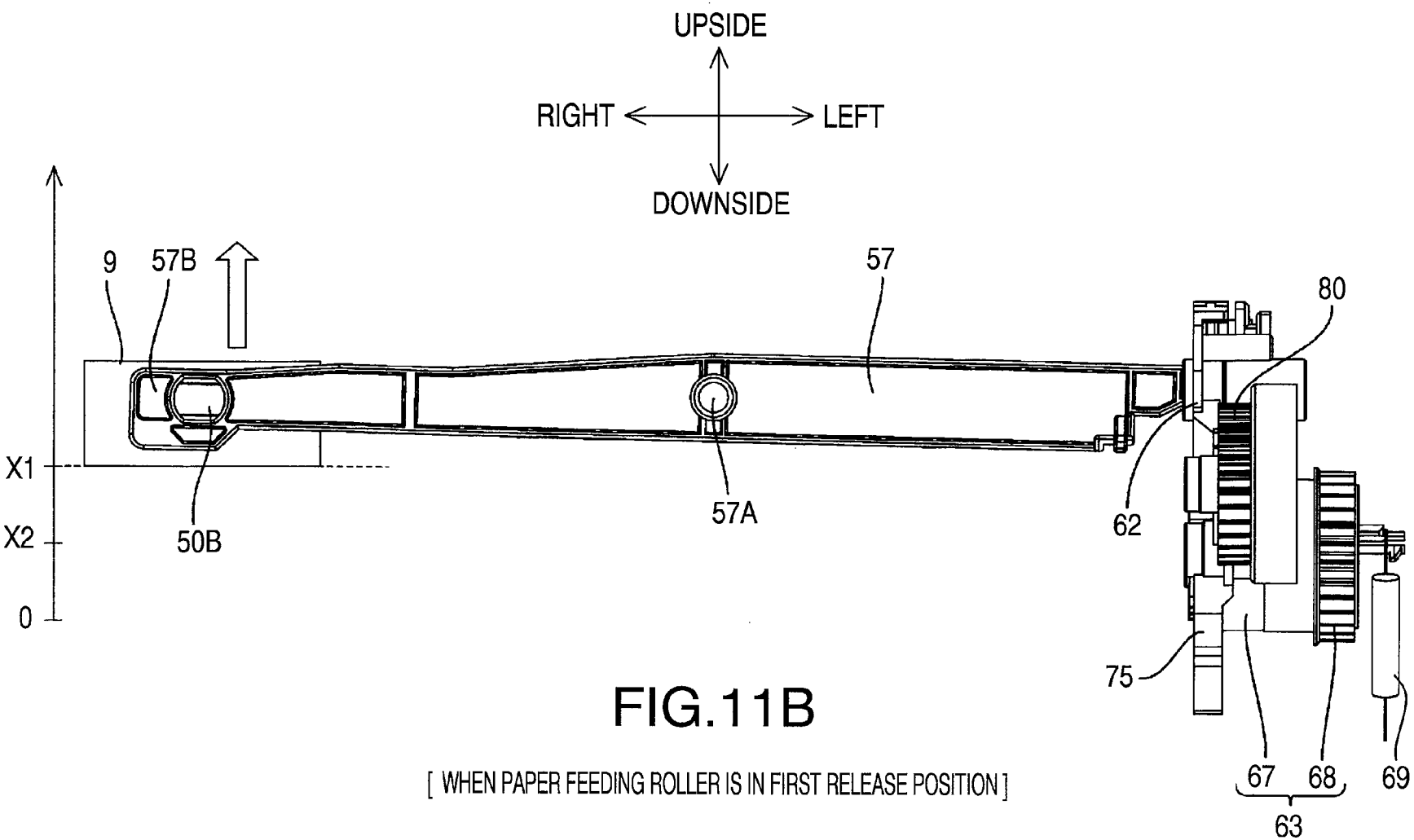
FIG. 11B is a rear side view of the gear mechanism in the case where the sheet feeding roller is in the first release position in the embodiment according to one or more aspects of the present invention.
Figure 11C:
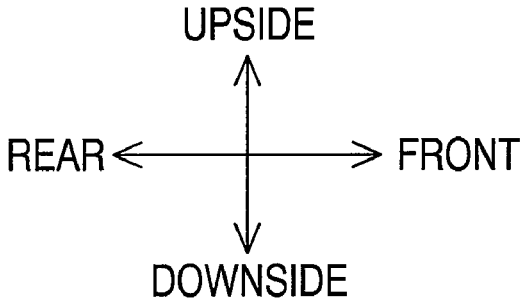
FIG. 11C is a left side view of the gear mechanism in the case where the sheet feeding roller is in the first release position in the embodiment according to one or more aspects of the present invention.
Figure 11C:
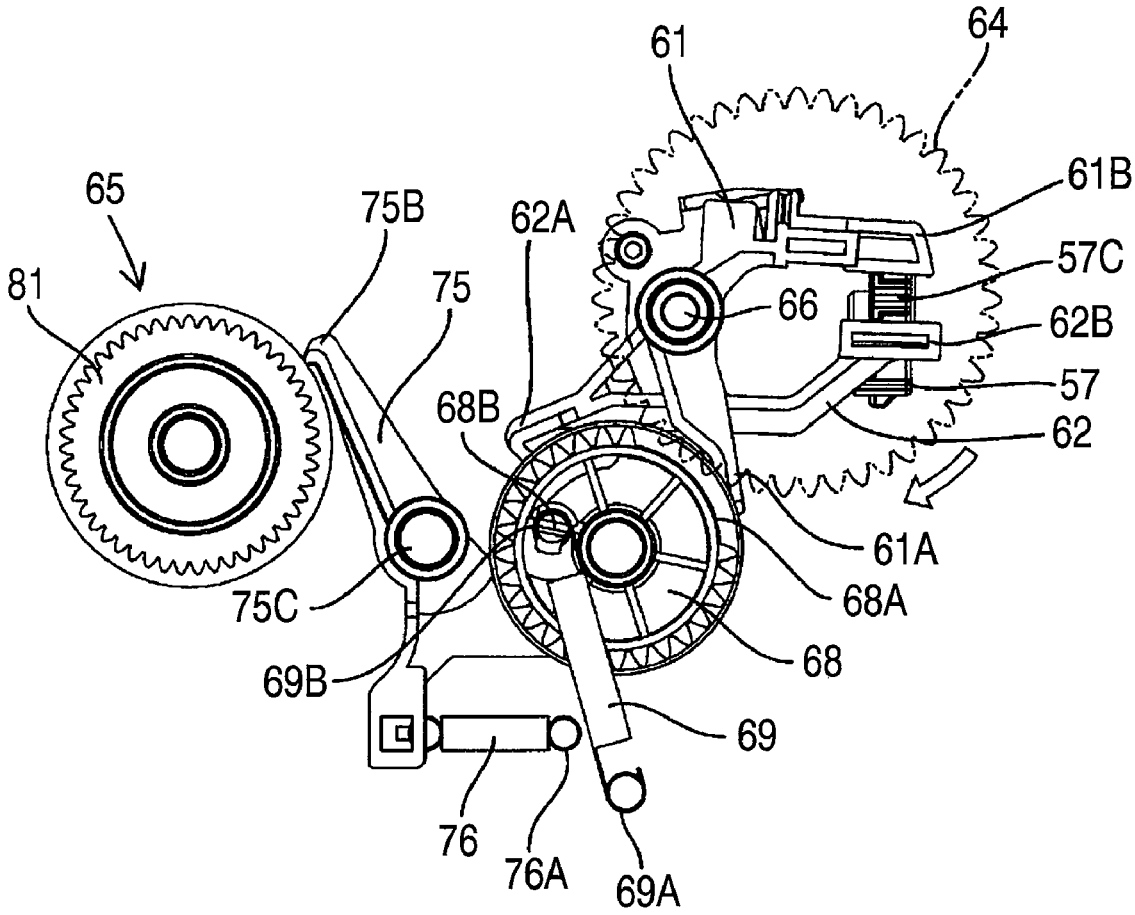

As illustrated in FIG. 11B, when the sheet feeding roller 9 reaches the first release position X1, the first engaging lever 61 contacts the cam 67 and waits for the first engaged portion 71 to come. Therefore, as shown in FIG. 11A, the first engaging lever 61 is engaged with the first engaged portion 71, and the cam gear 63 is stopped against the biasing force of the spring 69 (a rotational position of the cam 67 shown in FIGS. 11A to 11C is defined as a second rotational position in the present embodiment). At this time, since the front end portion 75A of the switching tilting member 75 runs upon the larger-radius portion of the cam 67, the pressing plate 11 is not lifted. In addition, as illustrated in FIG. 11C, the tooth-lacking gear 68, of which the tooth-lacking portion 68A is facing the differential gear 64, does not receive the driving force from the differential gear 64. It is noted that there is caused even in the present embodiment, a first time-lag until the cam 67 takes the second rotational position after the sheet feeding roller 9 reaches the first release position X1.

Figure 12A:
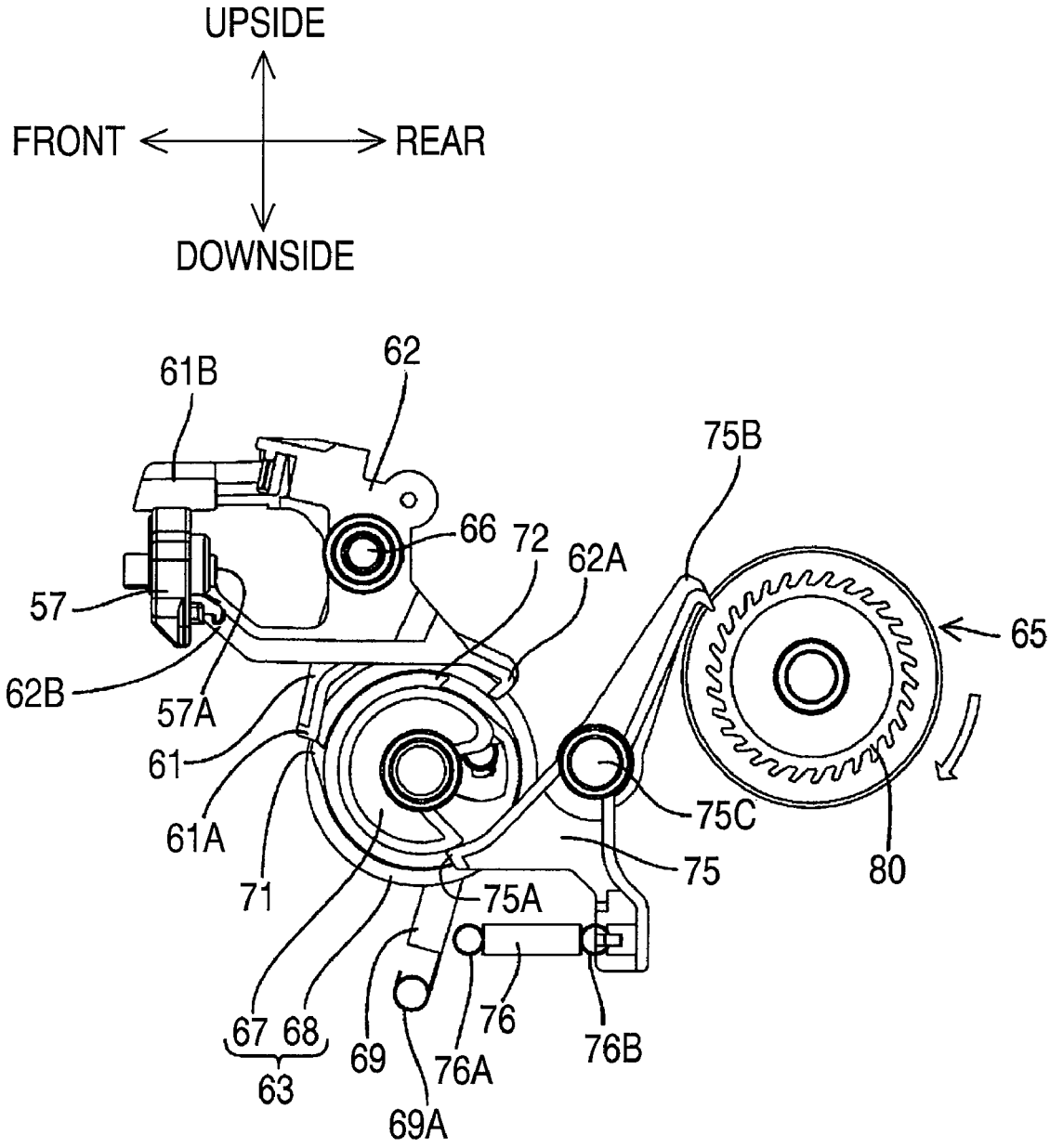
FIG. 12A is a right side view of the gear mechanism in a case where the sheet feeding roller is between the first release position and the second release position in the embodiment according to one or more aspects of the present invention.
Figure 12B:
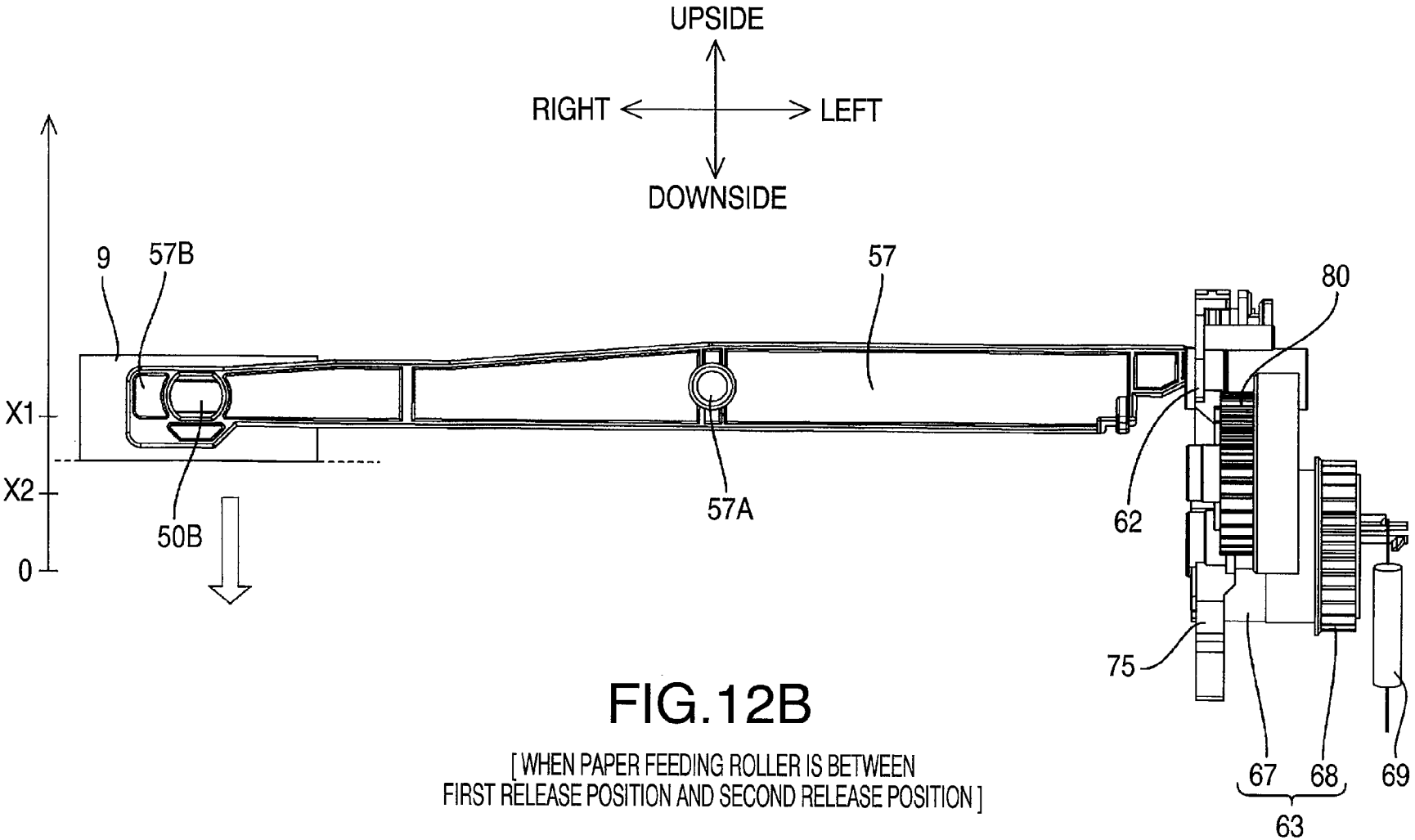
FIG. 12B is a rear side view of the gear mechanism in the case where the sheet feeding roller is between the first release position and the second release position in the embodiment according to one or more aspects of the present invention.
Figure 12C:
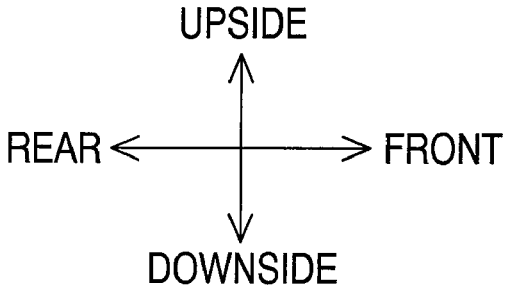
FIG. 12C is a left side view of the gear mechanism in the case where the sheet feeding roller is between the first release position and the second release position in the embodiment according to one or more aspects of the present invention.
Figure 12C:
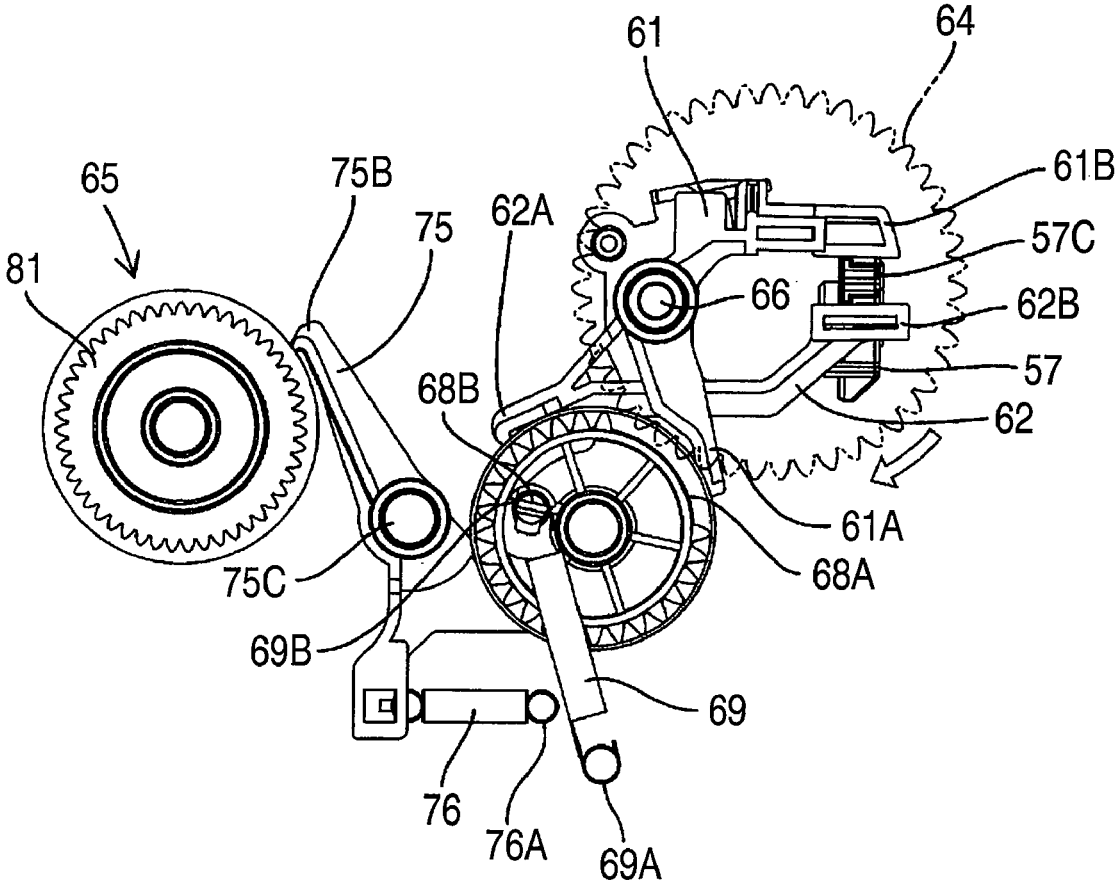

When the gear mechanism 60 is set into a state shown in FIG. 11B, the pressing plate 11 is set into the sheet feeding state, in which a sheet feeding operation is permitted. Then, based upon a sheet feeding command issued by a CPU (not shown), the sheet feeding roller 9 is rotated, the sheet 3 is fed to the image forming unit 5, and a printing operation is performed. After that, the sheet feeding operation is repeated, and when the number of sheets placed on the pressing plate 11 is reduced, for example, by about 10 sheets, the sheet feeding roller 9 is moved down to a position between the first release position X1 and the second release position X2 as shown in FIG. 12B. Then, as illustrated in FIG. 12A, the locking claw 61A of the first engaging lever 61 and the locking claw 62A of the second engaging lever 62 are slightly rotated in a clockwise direction of the figure, and the first engaging lever 61 is disengaged from the first engaged portion 71. It is noted that, at this time, the second engaging lever 62 is still in the position away from the cam 67 and is not engaged with the second engaged portion 72. Accordingly, the gear mechanism 60 again begins the operation of alternately repeating the operating state and stopped state in the intermittent lifting mode (in the state shown in FIGS. 10A to 10C). Thereafter, the gear mechanism 60 repeatedly performs operations of shifting to the state shown in FIGS. 12A to 12C from the state shown in FIGS. 10A to 10C (in the intermittent lifting mode). Further, it is noted that when the storage cassette 6 is drawn out from the feeder unit 4 and then re-attached thereinto, the gear mechanism 60 is set into the state shown in FIG. 9 and the continuous lifting mode is restarted.

(Summary of Operations)

Positions of the sheet feeding roller 9 depending on time will be described with reference to FIGS. 13 to 15. FIGS. 13 and 14 are schematic side views of the gear mechanism 60 for explaining operations of the cam gear 63, the first engaging lever 61, and the second engaging lever 62 when the storage cassette 6 is inserted and when the number of the sheets 3 on the pressing plate 11 is reduced through the sheet feeding operation, respectively. In FIGS. 13 and 14, operations in the present embodiment are shown on left sides of the figures, while operations in a comparative example are shown on right sides of the figures. FIG. 15 shows time dependency of height of the sheet feeding roller 9, where a solid line denotes the present embodiment, and a chain line denotes the comparative example.

1. Regarding when the Storage Cassette is Inserted (1) Operations in Embodiment

In the present embodiment, as shown in FIG. 13, when the storage cassette 6 is inserted, in the same manner as the comparative example, the second engaging lever 62 is engaged with the second engaged portion 72 of the cam gear 63 (see "pressing plate is being lifted up" of the present embodiment in FIG. 13). Thereby, the gear mechanism 60 is set in the operating state for lifting the pressing plate 11 as shown in FIG. 8A.

The sheet feeding roller 9 is in the lowest position O (FIG. 8B) at a time t0 (FIG. 15), and therefrom shifted up to the second release position X2 (FIG. 9B) at a time t1, where the engagement of the second engaging lever 62 with the second engaged portion 72 is released, and the cam gear 63 is rotated in a clockwise direction of FIG. 13 (see "sheet feeding roller reaches second release position X2" of the present embodiment in FIG. 13). At this time, the first engaging lever 61 does not contact the cam gear 63, yet gradually approaches the cam gear 63. Then, when the sheet feeding roller 9 reaches the second release position X1 (FIG. 11B) (at a time t2 in FIG. 15 at when an instruction for stopping lifting the pressing plate 11 is instructed), the first engaging lever 61 contacts the cam gear 63 (see "sheet feeding roller reaches first release position X1" of the present embodiment in FIG. 13).

After that, when the cam gear 63 takes the second rotational position, as shown in FIG. 13, the first engaging lever 61 is engaged with the first engaged portion 71 (see "pressing plate is stopped" of the present embodiment in FIG. 13). At this time, as illustrated in FIG. 15, the sheet feeding roller 9 is lifted up to a height X3 and stopped at a time t3. Here, a time period between t2 and t3 taken for the sheet feeding roller 9 to be lifted from the first release position X1 to the height X3 corresponds to the first time-lag in the present embodiment.

(2) Operations in Comparative Example

Unlike the present embodiment, in the comparative example, at the time (t1 in FIG. 15) when the sheet feeding roller 9 reaches the second release position X2, the engagement of the second engaging lever 62 with the second engaged portion 72 is not released (see "sheet feeding roller reaches second release position X2" of the comparative example in FIG. 13). Namely, the cam gear 63 is maintained in the first rotational position. Thereafter, when the sheet feeding roller 9 is further lifted up to the first release position X1 (at t2 in FIG. 15), as shown in "sheet feeding roller reaches first release position X1" of the comparative example in FIG. 13, firstly the first engaging lever 61 contacts the cam gear 63, and then the engagement of the second engaging lever 62 with the second engaged portion 72 is released around a time t2'. Thereby, finally the cam gear 63 is rotated in the clockwise direction of FIG. 13 toward the second rotational position. A time period between t2' and t3 corresponds to the second time-lag.

Thus, in the comparative example, when the sheet feeding roller 9 reaches the first release position X1, the first engaging lever 61 contacts the cam gear 63, and thereafter the engagement of the second engaging lever 62 with the second engaged portion 72 is released. This is because in the comparative example, unlike the present embodiment, when the sheet feeding roller 9 reaches the first release position X1, the cam gear 63 is still latched in the first rotational position by the second engaging lever 62. Therefore, in order to stop the rising of the pressing plate 11, firstly the engagement of the second engaging lever 62 with the second engaged portion 72 has to be released. Here, supposing that the comparative example is configured such that the engagement of the second engaging lever 62 with the second engaged portion 72 is released before the first engaging lever 61 contacts the cam gear 63, the first engaged portion 71 of the cam gear 63 may pass without being engaged with the first engaging lever 61 as still spaced from the cam gear 63. Thus, an undesired situation may be caused that it is delayed to stop the cam gear 63 in the second rotational position. To avoid such a situation, in the comparative example, when the sheet feeding roller 9 reaches the first release position X1, firstly the first engaging lever 61 is brought into contact with the cam gear 63, and then the engagement of the second engaging lever 62 with the second engaged portion 72 is released. The second time-lag is set in view of dimensional tolerances of the cam gear 63, the first engaging lever 61, and the second engaging lever 62. Then the first time-lag is caused after the second time-lag has elapsed. Consequently, the sheet feeding roller 9 is lifted up to a height X4 at a time t4 as shown in FIG. 15, and the pressing plate 11 is shifted up to a higher position than that in the present embodiment.

Hereinabove, in the comparative example, the second time-lag is caused as well as the first time-lag until the rising of the pressing plate 11 is actually stopped after the sheet feeding roller 9 reaches the first release position X1. On the contrary, in the present embodiment, before the sheet feeding roller 9 reaches the first release position X1, the engagement of the second engaging lever 62 with the second engaged portion 72 has already been released, and the cam gear 63 has been driven and rotated. Accordingly, in the present embodiment, the second time-lag is not caused at the time when the pressing plate 11 reaches the first release position X1. Furthermore, in the present embodiment, the engagement of the second engaging lever 62 with the second engaged portion 72 is released earlier than in the comparative example. Hence, a rising height amount of the pressing plate 11 is more constrained in the present embodiment than in the comparative example. Thus sheet feeding performance can be improved.

2. Regarding when Sheet Count is Reduced through Sheet Feeding Operation (1) Operations in Embodiment As shown in "while pressing plate is stopped in sheet feeding operation" of the present embodiment in FIG. 14, while the sheet feeding operation is performed with the sheet feeding roller 9, the first engaging lever 61 is engaged with the first engaged portion 71 of the cam gear 63. The sheet feeding roller 9 is moved lower along with decrease of the number of the sheets 3, as shown between a time t5 and a time t6 in FIG. 15.

At the time t6 when the sheet feeding roller 9 is shifted down to the height X5, as shown in "pressing plate is caused to be lifted up" of the present embodiment in FIG. 14, the engagement of the first engaging lever 61 with the first engaged portion 71 is released (see FIGS. 12A to 12C), and the cam gear 63 is rotated in a clockwise direction of FIG. 14. Thereby, the pressing plate 11 begins to intermittently rise, and when the sheet feeding roller 9 reaches the first release position X1 (at a time t7 in FIG. 15), the first engaging lever 61 contacts the cam gear 63 (see "sheet feeding roller reaches first release position X1" of the present embodiment in FIG. 14). Thereafter, when the cam gear 63 reaches the second rotational position, as illustrated in "pressing plate is stopped" of the present embodiment in FIG. 14, the first engaging lever 61 is engaged with the first engaged portion 71. At this time, as shown in FIG. 15, the sheet feeding roller 9 is lifted up to the height X3 and stopped at a time t8. Here, a time period between t7 and t8 taken for the sheet feeding roller 9 to be lifted from the first release position X1 to the height X3 corresponds to the first time-lag in the present embodiment.

(2) Operations in Comparative Example

In the comparative example, at a time t9 when the sheet feeding roller 9 is moved down to the height X5, as shown in "pressing plate is caused to be lifted up" of the comparative example in FIG. 14, the second engaging lever 62 contacts the cam gear 63, and the engagement of the first engaging lever 61 with the first engaged portion 71 is released. Thereby, the cam gear 63 is held in the first rotational position, and the pressing plate 11 begins to rise. After that, in the same manner as from "sheet feeding roller reaches first release position X1" to "pressing plate is stopped" of the comparative example in FIG. 13, the second time-lag is caused as well as the first time-lag until the rising of the pressing plate 11 is actually stopped after the sheet feeding roller 9 reaches the first release position X1 (see "sheet feeding roller reaches first release position" to "pressing plate is stopped" of the comparative example in FIG. 14, and a time period from t10 to t12 in FIG. 15).

Hereinabove, according to the present embodiment, the second time-lag is not caused as well when the number of the sheets 3 is reduced through the sheet feeding operation. Thus, the rising height amount of the pressing plate 11 is more constrained in the present embodiment than in the comparative example. Therefore the sheet feeding performance can be improved.

(Effects of Embodiment)

In the comparative example, even though a loading portion (which corresponds to the pressing plate 11 of the present embodiment) reaches a predetermined height (which corresponds to the first release position X1 of the present embodiment), a continuous lifting operation is maintained while a cam (which corresponds to the cam gear 63 of the present embodiment) is rotated from the first rotational position (a rotational position where a lifting mechanism is set to an operating state) to the second rotational position (a rotational position where a lifting mechanism is set to a stopped state). Further, since the height of the loading portion is mechanically detected, the second time-lag is caused until the cam is actually rotated after it is detected that the loading portion reaches the predetermined height. Accordingly, even though the loading portion reaches the predetermined height, the lifting operation is further maintained. Hence, an undesired situation might be caused in which a contact pressure between the sheet feeding roller and a sheet is increased too much and thus sheet feeding performance is deteriorated such that two or more sheets are fed together or that no sheet is fed.

On the contrary, in the present embodiment, the gear mechanism 60 alternately repeats the operating state and stopped state until the pressing plate 11 reaches the first release position X1. Thereby, the pressing plate 11 intermittently rises (intermittent lifting mode). Then, when the pressing plate 11 reaches the first release position X1, the cam 67 is stopped in a rotational position where the gear mechanism 60 is set to the stopped state (see FIGS. 11A to 11C). Even in the gear mechanism 60 of the present embodiment, it may be delayed that the cam 67 is rotated to the rotational position (see FIGS. 11A to 11C) where the gear mechanism 60 is set in the stopped state, with respect to the time when the sheet feeding roller 9 reaches the first release position X1 (the first time-lag). However, when the sheet feeding roller 9 reaches the first release position X1, and the engagement of the first engaging lever 61 with the first engaged portion 71 is released, the second engaging lever 62 is still in the position away from the cam 67, and is not engaged with the second engaged portion 72. Accordingly, the second time-lag as caused in the comparative example is not caused in the present embodiment. Namely, the cam 67 is driven and rotated immediately after the sheet feeding roller 9 reaches the first release position X1, and it can be avoided to lift the pressing plate 11 too high. Further, the pressing plate 11 is intermittently lifted. Therefore, it can be prevented that the sheet feeding roller 9 is lifted too far from the first release position X1.

Further, a rising speed of the pressing plate 11 in the intermittent lifting mode is lower than that in the continuous lifting mode. In addition, a sound is emitted in the intermittent lifting mode when the engagement of the first engaging lever 61 with the first engaged portion 71 is established and released. On the contrary, in the continuous lifting mode, engagement of any lever 61 or 62 is not established or released. In the present embodiment, the continuous lifting mode is implemented until the pressing plate 11 reaches the second release position X2, and the mode is switched to the intermittent lifting mode when the pressing plate 11 is lifted in or higher than the second release position X2. Thereby, it is possible to increase the rising speed of the pressing plate 11 and reduce noises until the pressing plate 11 reaches the second release position X2.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

(Modifications)

In the aforementioned embodiment, the first engaging lever 61 and the second engaging lever 62 are configured as different members, respectively. However, they may be configured to be swung as a single integrated member.

The aforementioned "sheet" may include an OHP sheet and a banknote as well as a recording medium.

The aforementioned "feeder unit" may be a unit configured to be detachably attached or a unit configured to be undetachably attached to a main body of an image forming apparatus (e.g., printer, facsimile machine, and multi function peripheral with a printer function and a scanner function). Further, the aforementioned "feeder unit" is not limited to a unit configured to feed a sheet to the main body of the image forming apparatus. The aforementioned "feeder unit" may be incorporated in an apparatus configured to count the number of sheets such as banknotes.

In the aforementioned embodiment, the feeder unit according to aspects of the present invention is applied to the laser printer. However, the feeder unit may be applied to various image forming apparatuses such as a printer having an LED as an exposure unit and an inkjet printer. Furthermore, the feeder unit may be applied to a sheet feeding apparatus configured to feed a sheet such as a banknote.

What is claimed is:

1. A sheet feeding device, comprising:

a loading portion configured to be loaded with a stack of sheets and to be movable up and down;

a lifting mechanism configured to lift the loading portion in an operating state and to stop lifting the loading portion in a stopped state;

a cam configured to be rotated alternately to a first rotational position for setting the lifting mechanism to the operating state and to a second rotational position for setting the lifting mechanism to the stopped state;

a detecting unit having a contact portion configured to be movable up and down while contacting a top sheet of the stack on the loading portion, the detecting unit being configured to detect whether the top sheet reaches a first height based upon the movement of the contact portion and to detect whether the top sheet reaches a second height lower than the first height; and a control unit configured to stop the cam in the first rotational position until the detecting unit detects that the top sheet reaches the second height and to start rotating the cam before the detecting unit detects that the top sheet reaches the first height such that the lifting mechanism lifts the loading portion intermittently while switching between the operating state and the stopped state, wherein the control unit is further configured to stop the cam in the second rotational position in response to the detecting unit detecting that the top sheet reaches the first height.

2. The sheet feeding device according to claim 1, wherein the control unit includes:

a tooth-lacking gear having a tooth-lacking portion, the tooth-lacking gear being configured to be rotated integrally with the cam;

a driving gear configured to be engaged with the tooth-lacking gear so as to drive the tooth-lacking gear;

a first engaging member configured to be shifted between a locking position for locking the cam such that the tooth-lacking portion of the tooth-lacking gear faces the driving gear and an unlocking position for unlocking the cam; and a rotation causing unit configured to cause the tooth-lacking gear to rotate such that teeth of the tooth-lacking gear are engaged with the driving gear, and wherein the control unit shifts the first engaging member from the unlocking position to the locking position when the detecting unit detects that the top sheet reaches the first height.

3. The sheet feeding device according to claim 2, wherein the control unit includes a second engaging member configured to be shifted between a latching position for latching the cam such that the tooth-lacking portion of the tooth-lacking gear faces the driving gear and an unlatching position for unlatching the cam, and wherein the control unit shifts the second engaging member from the latching position to the unlatching position when the detecting unit detects that the top sheet reaches the second height.

4. The sheet feeding device according to claim 3, wherein the first engaging member and the second engaging member are configured to be shifted concentrically and integrally.

5. The sheet feeding device according to claim 1, wherein the control unit includes:

a driving gear configured to drive the lifting mechanism; and a switching unit configured to switch an operation mode of the driving gear between a first mode for causing the driving gear to drive the lifting mechanism when the cam is in the first rotational position and a second mode for causing the driving gear not to drive the lifting mechanism.

6. An image forming apparatus, comprising:

a sheet feeding unit configured to feed a sheet; and an image forming unit configured to form an image on the sheet fed by the sheet feeding unit, wherein the sheet feeding unit includes:

a loading portion configured to be loaded with a stack of sheets and to be movable up and down;

a lifting mechanism configured to lift the loading portion in an operating state and to stop the lifting the loading portion in a stopped state;

a cam configured to be rotated alternately to a first rotational position for setting the lifting mechanism to the operating state and to a second rotational position for setting the lifting mechanism to the stopped state;

a detecting unit having a contact portion configured to be movable up and down while contacting a top sheet of the stack on the loading portion, the detecting unit being configured to detect whether the top sheet reaches a first height based upon the movement of the contact portion and to detect whether the top sheet reaches a second height lower than the first height; and a control unit configured to stop the cam in the first rotational position until the detecting unit detects that the top sheet reaches the second height and to start rotating the cam before the detecting unit detects that the top sheet reaches the first height such that the lifting mechanism lifts the loading portion intermittently while switching between the operating state and the stopped state, wherein the control unit is further configured to stop the cam in the second rotational position in response to the detecting unit detecting that the top sheet reaches the first height.

7. The image forming apparatus according to claim 6, wherein the control unit includes:

a tooth-lacking gear having a tooth-lacking portion, the tooth-lacking gear being configured to be rotated integrally with the cam;

a driving gear configured to be engaged with the tooth-lacking gear so as to drive the tooth-lacking gear;

a first engaging member configured to be shifted between a locking position for locking the cam such that the tooth-lacking portion of the tooth-lacking gear faces the driving gear and an unlocking position for unlocking the cam; and a rotation causing unit configured to cause the tooth-lacking gear to rotate such that teeth of the tooth-lacking gear are engaged with the driving gear, and wherein the control unit shifts the first engaging member from the unlocking position to the locking position when the detecting unit detects that the top sheet reaches the first height.

8. The image forming apparatus according to claim 7, wherein the control unit includes a second engaging member configured to be shifted between a latching position for latching the cam such that the tooth-lacking portion of the tooth-lacking gear faces the driving gear and an unlatching position for unlatching the cam, and wherein the control unit shifts the second engaging member from the latching position to the unlatching position when the detecting unit detects that the top sheet reaches the second height.

9. The image forming apparatus according to claim 8, wherein the first engaging member and the second engaging member are configured to be shifted concentrically and integrally.

10. The image forming apparatus according to claim 6, wherein the control unit includes:

a driving gear configured to drive the lifting mechanism; and a switching unit configured to switch an operation mode of the driving gear between a first mode for causing the driving gear to drive the lifting mechanism when the cam is in the first rotational position and a second mode for causing the driving gear not to drive the lifting mechanism.

11. A sheet feeding device, comprising:

a loading portion configured to be loaded with a stack of sheets and to be movable up and down;

a lifting mechanism configured to lift the loading portion in an operating state and to stop lifting the loading portion in a stopped state;

a cam configured to be rotated alternately to a first rotational position for setting the lifting mechanism to the operating state and to a second rotational position for setting the lifting mechanism to the stopped state;

a detecting unit having a contact portion configured to be movable up and down while contacting a top sheet of the stack on the loading portion, the detecting unit being configured to detect whether the top sheet reaches a first height based upon the movement of the contact portion; and a control unit configured to rotate the cam before the detecting unit detects that the top sheet reaches the first height and to stop the cam in the second rotational position in response to the detecting unit detecting that the top sheet reaches the first height, the control unit including:

a tooth-lacking gear having a tooth-lacking portion, the tooth-lacking gear being configured to be rotated integrally with the cam;

a driving gear configured to be engaged with the tooth-lacking gear so as to drive the tooth-lacking gear;

a first engaging member configured to be shifted between a locking position for locking the cam such that the tooth-lacking portion of the tooth-lacking gear faces the driving gear and an unlocking position for unlocking the cam; and a rotation causing unit configured to cause the tooth-lacking gear to rotate such that teeth of the tooth-lacking gear are engaged with the driving gear, wherein the control unit shifts the first engaging member from the unlocking position to the locking position when the detecting unit detects that the top sheet reaches the first height, wherein the detecting unit is configured to detect whether the top sheet reaches a second height lower than the first height, wherein the control unit includes a second engaging member configured to be shifted between a latching position for latching the cam such that the tooth-lacking portion of the tooth-lacking gear faces the driving gear and an unlatching position for unlatching the cam, and wherein the control unit shifts the second engaging member from the latching position to the unlatching position when the detecting unit detects that the top sheet reaches the second height.

12. The sheet feeding device according to claim 11, wherein the first engaging member and the second engaging member are configured to be shifted concentrically and integrally.

13. An image forming apparatus, comprising:

a sheet feeding unit configured to feed a sheet; and an image forming unit configured to form an image on the sheet fed by the sheet feeding unit, wherein the sheet feeding unit includes:

a loading portion configured to be loaded with a stack of sheets and to be movable up and down;

a lifting mechanism configured to lift the loading portion in an operating state and to stop the lifting of the loading portion in a stopped state;

a cam configured to be rotated alternately to a first rotational position for setting the lifting mechanism to the operating state and to a second rotational position for setting the lifting mechanism to the stopped state;

a detecting unit having a contact portion configured to be movable up and down while contacting a top sheet of the stack on the loading portion, the detecting unit being configured to detect whether the top sheet reaches a first height based upon the movement of the contact portion; and a control unit configured to rotate the cam before the detecting unit detects that the top sheet reaches the first height and to stop the cam in the second rotational position in response to the detecting unit detecting that the top sheet reaches the first height, the control unit including:

a tooth-lacking gear having a tooth-lacking portion, the tooth-lacking gear being configured to be rotated integrally with the cam;

a driving gear configured to be engaged with the tooth-lacking gear so as to drive the tooth-lacking gear;

a first engaging member configured to be shifted between a locking position for locking the cam such that the tooth-lacking portion of the tooth-lacking gear faces the driving gear and an unlocking position for unlocking the cam; and a rotation causing unit configured to cause the tooth-lacking gear to rotate such that teeth of the tooth-lacking gear are engaged with the driving gear, wherein the control unit shifts the first engaging member from the unlocking position to the locking position when the detecting unit detects that the top sheet reaches the first height, wherein the detecting unit is configured to detect whether the top sheet reaches a second height lower than the first height, wherein the control unit includes a second engaging member configured to be shifted between a latching position for latching the cam such that the tooth-lacking portion of the tooth-lacking gear faces the driving gear and an unlatching position for unlatching the cam, and wherein the control unit shifts the second engaging member from the latching position to the unlatching position when the detecting unit detects that the top sheet reaches the second height.

14. The image forming apparatus according to claim 13, wherein the first engaging member and the second engaging member are configured to be shifted concentrically and integrally.

* * * * *